US012310396B2

(12) United States Patent
Dull et al.

(10) Patent No.: US 12,310,396 B2
(45) Date of Patent: May 27, 2025

(54) METHOD FOR HYDROLYSIS OF LACTIC ACID FOR AEROSOL DELIVERY DEVICE

(71) Applicant: RAI Strategic Holdings, Inc., Winston-Salem, NC (US)

(72) Inventors: Gary M. Dull, Lewisville, NC (US); Thomas H. Poole, Winston-Salem, NC (US); Serban C. Moldoveanu, Winston-Salem, NC (US); Frank Kelley St. Charles, Bowling Green, KY (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 1032 days.

(21) Appl. No.: 16/811,548

(22) Filed: Mar. 6, 2020

(65) Prior Publication Data

US 2020/0281250 A1 Sep. 10, 2020

Related U.S. Application Data

(60) Provisional application No. 62/815,666, filed on Mar. 8, 2019.

(51) Int. Cl.
*A24B 15/167* (2020.01)
*A24B 15/24* (2006.01)
(Continued)

(52) U.S. Cl.
CPC ..... *A24B 15/167* (2016.11); *A24B 15/243* (2013.01); *A24B 15/32* (2013.01); *A24F 40/10* (2020.01)

(58) Field of Classification Search
CPC ..... A24B 15/167; A24B 15/243; A24B 15/32; A24F 40/10; A24F 40/42; A61K 9/0078
See application file for complete search history.

(56) References Cited

U.S. PATENT DOCUMENTS 4,793,365 A 12/1988 Sensabaugh, Jr. et al.
5,101,839 A 4/1992 Jakob et al.
(Continued)

FOREIGN PATENT DOCUMENTS

WO WO 98/57556 12/1998
WO WO 2014/182736 11/2014

OTHER PUBLICATIONS

PD Watson, Composition of Lactic Acid "Production of Highly Concentrated Lactic Acid," *Ind. Eng. Chem.* 1940, 32(3), pp. 399-401. https://pubs.acs.org/doi/pdf/10.1021/ie50363a027.

*Primary Examiner* — Philip Y Louie
*Assistant Examiner* — Yana B Krinker
(74) *Attorney, Agent, or Firm* — Womble Bond Dickinson (US) LLP

(57) ABSTRACT

A method for preparing an aerosol precursor composition is provided, which includes the steps of providing a first aqueous solution comprising one or more organic acids in water; subjecting the first aqueous solution to hydrolysis to give a hydrolyzed aqueous solution with a higher organic acid monomer content on a dry weight basis than in the first aqueous solution; and combining the hydrolyzed aqueous solution with one or more aerosol formers to give an aerosol precursor composition. Typically, the aerosol precursor composition further contains nicotine. The disclosed method can lead to enhanced control over the composition and characteristics of the produced aerosol precursor composition.

19 Claims, 9 Drawing Sheets

(51) Int. Cl.
*A24B 15/32* (2006.01)
*A24F 40/10* (2020.01)

(56) References Cited

U.S. PATENT DOCUMENTS

| | | | | |
|---|---|---|---|---|
| 7,726,320 | B2 | 6/2010 | Robinson et al. | |
| 8,881,737 | B2 | 11/2014 | Collett et al. | |
| 10,505,383 | B2 | 12/2019 | Sur | |
| 10,517,326 | B2 | 12/2019 | Sur et al. | |
| 10,660,365 | B2 | 5/2020 | Lipowicz et al. | |
| 2002/0157937 | A1 | 10/2002 | Cockrem et al. | |
| 2013/0008457 | A1 | 1/2013 | Zheng et al. | |
| 2013/0213417 | A1 | 8/2013 | Chong et al. | |
| 2014/0060554 | A1 | 3/2014 | Collett et al. | |
| 2014/0261486 | A1 | 9/2014 | Potter et al. | |
| 2014/0283859 | A1 | 9/2014 | Minskoff et al. | |
| 2015/0020823 | A1* | 1/2015 | Lipowicz | A24F 40/42 131/359 |
| 2015/0020824 | A1* | 1/2015 | Bowen | A61K 47/10 131/328 |
| 2015/0020830 | A1 | 1/2015 | Koller | |
| 2015/0216232 | A1 | 8/2015 | Bless et al. | |
| 2015/0313282 | A1 | 11/2015 | Ademe et al. | |
| 2015/0335070 | A1 | 11/2015 | Sears et al. | |
| 2015/0335071 | A1 | 11/2015 | Brinkley et al. | |
| 2016/0007651 | A1 | 1/2016 | Ampolini et al. | |
| 2016/0050975 | A1 | 2/2016 | Worm et al. | |
| 2016/0073695 | A1* | 3/2016 | Sears | H05B 3/46 131/329 |
| 2017/0095002 | A1* | 4/2017 | Silvestrini | A61M 11/042 |
| 2018/0103680 | A1 | 4/2018 | Fariss | |
| 2019/0116863 | A1* | 4/2019 | Dull | A24B 15/167 |

* cited by examiner

METHOD FOR HYDROLYSIS OF LACTIC ACID FOR AEROSOL DELIVERY DEVICE

CROSS-REFERENCE

The present application claims priority to U.S. Provisional Patent Application No. 62/815,666, filed Mar. 8, 2019, which is incorporated herein by reference in its entirety.

FIELD OF THE DISCLOSURE

The present disclosure relates to aerosol delivery devices such as smoking articles, and more particularly to aerosol delivery devices that may utilize electrically generated heat for the production of aerosol (e.g., smoking articles commonly referred to as electronic cigarettes). The smoking articles may be configured to heat an aerosol precursor, which may incorporate materials that may be made or derived from, or otherwise incorporate tobacco, the precursor being capable of forming an inhalable substance for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar or pipe smoking, but without delivering considerable quantities of incomplete combustion and pyrolysis products that result from the burning of tobacco. To this end, there have been proposed numerous smoking products, flavor generators and medicinal inhalers that utilize electrical energy to vaporize or heat a volatile material, or attempt to provide the sensations of cigarette, cigar or pipe smoking without burning tobacco to a significant degree. See, for example, the various alternative smoking articles, aerosol delivery devices and heat generating sources set forth in the background art described in U.S. Pat. Nos. 7,726,320 to Robinson et al. and 8,881,737 to Collett et al., which are incorporated herein by reference. See also, for example, the various types of smoking articles, aerosol delivery devices and electrically-powered heat generating sources referenced by brand name and commercial source in U.S. Pat. Pub. No. 2015/0216232 to Bless et al., which is incorporated herein by reference. Additionally, various types of electrically powered aerosol and vapor delivery devices also have been proposed in U.S. Pat. Appl. Pub. Nos. 2014/0096781 to Sears et al., 2014/0283859 to Minskoff et al., 2015/0335070 to Sears et al., 2015/0335071 to Brinkley et al., 2016/0007651 to Ampolini et al., and 2016/0050975 to Worm et al., all of which are incorporated herein by reference. Some of these alternative smoking articles, e.g., aerosol delivery devices, have replaceable cartridges or refillable tanks of aerosol precursor (e.g., smoke juice, e-liquid, or e-juice).

It would be desirable to provide alternative methods for preparing the aerosol precursor of such aerosol delivery devices.

BRIEF SUMMARY

The present disclosure is related to methods of preparing aerosol precursor compositions, e.g., for use in aerosol delivery devices such as electronic cigarettes, and to the compositions provided by such methods. Certain benefits, e.g., component stability are afforded by such methods, as will be outlined fully herein below.

In one aspect, the disclosure provides a method for preparing an aerosol precursor composition, comprising: method for preparing an aerosol precursor composition, comprising: providing a first aqueous solution comprising one or more organic acids in water; subjecting the first aqueous solution to hydrolysis to give a hydrolyzed aqueous solution with a higher organic acid monomer content on a dry weight basis than in the first aqueous solution; and combining the hydrolyzed aqueous solution with one or more aerosol formers to give an aerosol precursor composition. In some embodiments, the method further comprises: determining a target organic acid monomer content to be included within the aerosol precursor composition; and determining appropriate conditions to ensure the hydrolyzed aqueous solution comprises an organic acid monomer content sufficient to achieve the target organic acid monomer content in the aerosol precursor composition.

In some embodiments, the method further comprises adding nicotine. The addition of nicotine can be done in varying ways, e.g., by combining the nicotine with the hydrolyzed aqueous solution, by combining the nicotine with the one or more aerosol formers, or combining the nicotine with a combination (a mixture of the hydrolyzed aqueous solution and the one or more aerosol formers) to give the aerosol precursor composition (which comprises nicotine). The nicotine can be tobacco-derived or non-tobacco derived (e.g., can be synthetically prepared).

In some embodiments, the aqueous solution comprises, in addition to the one or more organic acids, reaction products of the organic acids. In some embodiments, the aqueous solution comprises, in addition to the one or more organic acids, one or more reaction products selected from the group consisting of acid dimers, acid trimers, acid oligomers, and acid polymers. The organic acid(s) can vary. In certain embodiments, the one or more organic acids are hydroxy acids. The one or more organic acids, in some embodiments, are selected from the group consisting of levulinic acid, succinic acid, lactic acid, pyruvic acid, benzoic acid, fumaric acid, and combinations thereof. In specific embodiments, the one or more organic acids include lactic acid (e.g., alone or in combination with one or more other acids).

The hydrolysis, in some embodiments, comprises heating the first aqueous solution, e.g., at a temperature of 40° C. or higher or at a temperature of 50° C. or higher. The hydrolysis is generally conducted such that the amount of water present in the aqueous solution is sufficient to promote hydrolysis. In some embodiments, the first aqueous solution comprises at least about 10% by weight water. In some embodiments, the first aqueous solution comprises at least about 20% by weight water.

The hydrolyzed aqueous solution, in certain embodiments, contains an increased content of monomeric organic acid by dry weight as compared to the first aqueous solution. In some embodiments, the hydrolyzed aqueous solution contains at least about 85% of the organic acid by dry weight. In some embodiments, the hydrolyzed aqueous solution contains at least about 88% of the organic acid by dry weight. In some embodiments, the hydrolyzed aqueous solution contains at least about 90% of the organic acid by dry weight. In some embodiments, the hydrolyzed aqueous solution contains at least about 95% of the organic acid by dry weight.

The one or more aerosol formers employed to give an aerosol precursor composition can vary. In some embodiments, the one or more aerosol formers comprise polyols and in some embodiments, they are polyols. In certain embodiments, the hydrolyzed aqueous solution has a pH less than about 8, and in some embodiments, less than about 7. In some embodiments, the corresponding aerosol precursor composition has a pH less than about 8 or less than about 7.

The disclosed method can, in certain embodiments, further comprise adding additional components before or after the combining step. For example, such additional components include, but are not limited to, flavorants. In certain embodiments, the method further comprises storing the aerosol precursor composition in an environment at a relative humidity greater than 40% (e.g., under typical manufacturing conditions such as 40-60%). In some embodiments, the disclosed method further comprises incorporating the aerosol precursor composition within an aerosol delivery device, such as within a cartridge for an aerosol delivery device.

In a further aspect of the disclosure is provided a method for preparing an aerosol precursor composition, comprising: combining a suitably dilute solution of acid in water (e.g., a solution that is commercially available) with nicotine and one or more aerosol formers to give an aerosol precursor composition. For example, the commercially available solution of acid in water, in some embodiments, comprises about 75% of the acid or less by weight or about 50% of the acid or less by weight. Some suitable solutions comprise about 85-90% acid by weight. In some embodiments, the nicotine in such aerosol precursor composition is tobacco-derived and in some embodiments, the nicotine is non-tobacco-derived.

In a further embodiment, the disclosure provides a method of enhancing stability of an organic acid-containing aqueous solution, comprising: subjecting the organic acid-containing aqueous solution to hydrolysis; and storing the hydrolyzed organic acid-containing aqueous solution in solution form, wherein enhancing stability is measured by evaluating the content of acid monomer by dry weight in solution (e.g., by refractive index analysis). In some embodiments, the content of acid monomer by dry weight in solution does not deviate by more than 5% over a period of 6 months of storage at ambient temperature.

In another aspect of the disclosure, a cartridge for an aerosol delivery device is provided, which includes an aerosol precursor composition prepared in accordance with various embodiments disclosed herein. In still a further aspect of the disclosure, a container (e.g., bottle) of aerosol precursor composition for use in aerosol delivery devices (e.g., open aerosol delivery devices in which a user may refill a cartridge or container with aerosol precursor composition) is provided. The aerosol precursor composition contained in the container of such embodiments may be prepared in accordance with the method of various embodiments disclosed herein.

The present disclosure includes, without limitation, the following embodiments:

Embodiment 1: A method for preparing an aerosol precursor composition, comprising: providing a first aqueous solution comprising one or more organic acids in water; subjecting the first aqueous solution to hydrolysis to give a hydrolyzed aqueous solution with a higher organic acid monomer content on a dry weight basis than in the first aqueous solution; and combining the hydrolyzed aqueous solution with one or more aerosol formers to give an aerosol precursor composition.

Embodiment 2: The method of the preceding embodiment, further comprising adding nicotine to the hydrolyzed aqueous solution, the one or more aerosol formers, or a combination thereof to give the aerosol precursor composition.

Embodiment 3: The method of any preceding embodiment, wherein the nicotine is tobacco-derived Embodiment 4: The method of any preceding embodiment, wherein the nicotine is non-tobacco-derived.

Embodiment 5: The method of any preceding embodiment, further comprising: determining a target organic acid content to be included within the aerosol precursor composition; and determining appropriate conditions to ensure the hydrolyzed aqueous solution comprises an organic acid content sufficient to achieve the target organic acid content in the aerosol precursor composition.

Embodiment 6: The method of any preceding embodiment, wherein the aqueous solution comprises, in addition to the one or more organic acids, reaction products of the organic acids.

Embodiment 7: The method of any preceding embodiment, wherein the aqueous solution comprises, in addition to the one or more organic acids, one or more acid dimers, acid oligomers, and acid polymers.

Embodiment 8: The method of any preceding embodiment, wherein the one or more organic acids are selected from the group consisting of levulinic acid, succinic acid, lactic acid, pyruvic acid, benzoic acid, fumaric acid, and combinations thereof.

Embodiment 9: The method of any preceding embodiment, wherein the one or more organic acids include lactic acid.

Embodiment 10: The method of any preceding embodiment, wherein the hydrolysis comprises heating the first aqueous solution.

Embodiment 11: The method of any preceding embodiment, wherein the first aqueous solution comprises at least about 10% by weight water.

Embodiment 12: The method of any preceding embodiment, wherein the hydrolyzed aqueous solution contains at least about 85% of the organic acid by dry weight.

Embodiment 13: The method of any preceding embodiment, wherein the hydrolyzed aqueous solution contains at least about 88% of the organic acid by dry weight.

Embodiment 14: The method of any preceding embodiment, wherein the hydrolyzed aqueous solution contains at least about 90% of the organic acid by dry weight.

Embodiment 15: The method of any preceding embodiment, wherein the hydrolyzed aqueous solution contains at least about 95% of the organic acid by dry weight.

Embodiment 16: The method of any preceding embodiment, wherein the one or more aerosol formers comprise polyols.

Embodiment 17: The method of any preceding embodiment, wherein the aerosol precursor composition has a pH less than about 8.

Embodiment 18: The method of any preceding embodiment, further comprising adding additional components before, after, or during the combining step.

Embodiment 19: The method of any preceding embodiment, wherein the additional components are flavorants.

Embodiment 20: The method of any preceding embodiment, further comprising incorporating the aerosol precursor composition within a cartridge for an aerosol delivery device.

Embodiment 21: A method for preparing an aerosol precursor composition, comprising: combining a commercially available solution of acid in water with nicotine and one or more aerosol formers to give an aerosol precursor composition.

Embodiment 22: The method of any preceding embodiment, wherein the nicotine is tobacco-derived.

Embodiment 23: The method of any preceding embodiment, wherein the nicotine is non-tobacco-derived.

Embodiment 24: The method of any preceding embodiment, wherein the commercially available solution of acid in water comprises about 75% of the acid or less by weight.

Embodiment 25: The method of any preceding embodiment, wherein the commercially available solution of acid in water comprises about 50% of the acid or less by weight.

Embodiment 26: The method of any preceding embodiment, wherein the acid comprises lactic acid.

Embodiment 27: The method of any preceding embodiment, further comprising incorporating the aerosol precursor composition within a cartridge for an aerosol delivery device.

Embodiment 28: A method of enhancing stability of an organic acid-containing aqueous solution, comprising: subjecting the organic acid-containing aqueous solution to hydrolysis; and storing the hydrolyzed organic acid-containing aqueous solution in solution form, wherein enhanced stability is measured by evaluating the content of acid monomer by dry weight in solution.

Embodiment 29: The method of any preceding embodiment, wherein the content of acid monomer by dry weight in solution does not deviate by more than 5% over a period of 6 months of storage at ambient temperature.

Embodiment 30: A container comprising an aerosol precursor composition prepared by the method of any preceding embodiment.

Embodiment 31: The container of the preceding embodiment, comprising a cartridge for an aerosol delivery device.

These and other features, aspects, and advantages of the present disclosure will be apparent from a reading of the following detailed description together with the accompanying drawings, which are briefly described below. The present disclosure includes any combination of two, three, four, or more features or elements set forth in this disclosure or recited in any one or more of the claims, regardless of whether such features or elements are expressly combined or otherwise recited in a specific embodiment description or claim herein. This disclosure is intended to be read holistically such that any separable features or elements of the disclosure, in any of its aspects and embodiments, should be viewed as intended to be combinable, unless the context of the disclosure clearly dictates otherwise.

BRIEF DESCRIPTION OF THE DRAWING(S)

Having thus described the disclosure in the foregoing general terms, reference will now be made to the accompanying drawings, which are not necessarily drawn to scale, and wherein:

DETAILED DESCRIPTION

Figure 1:
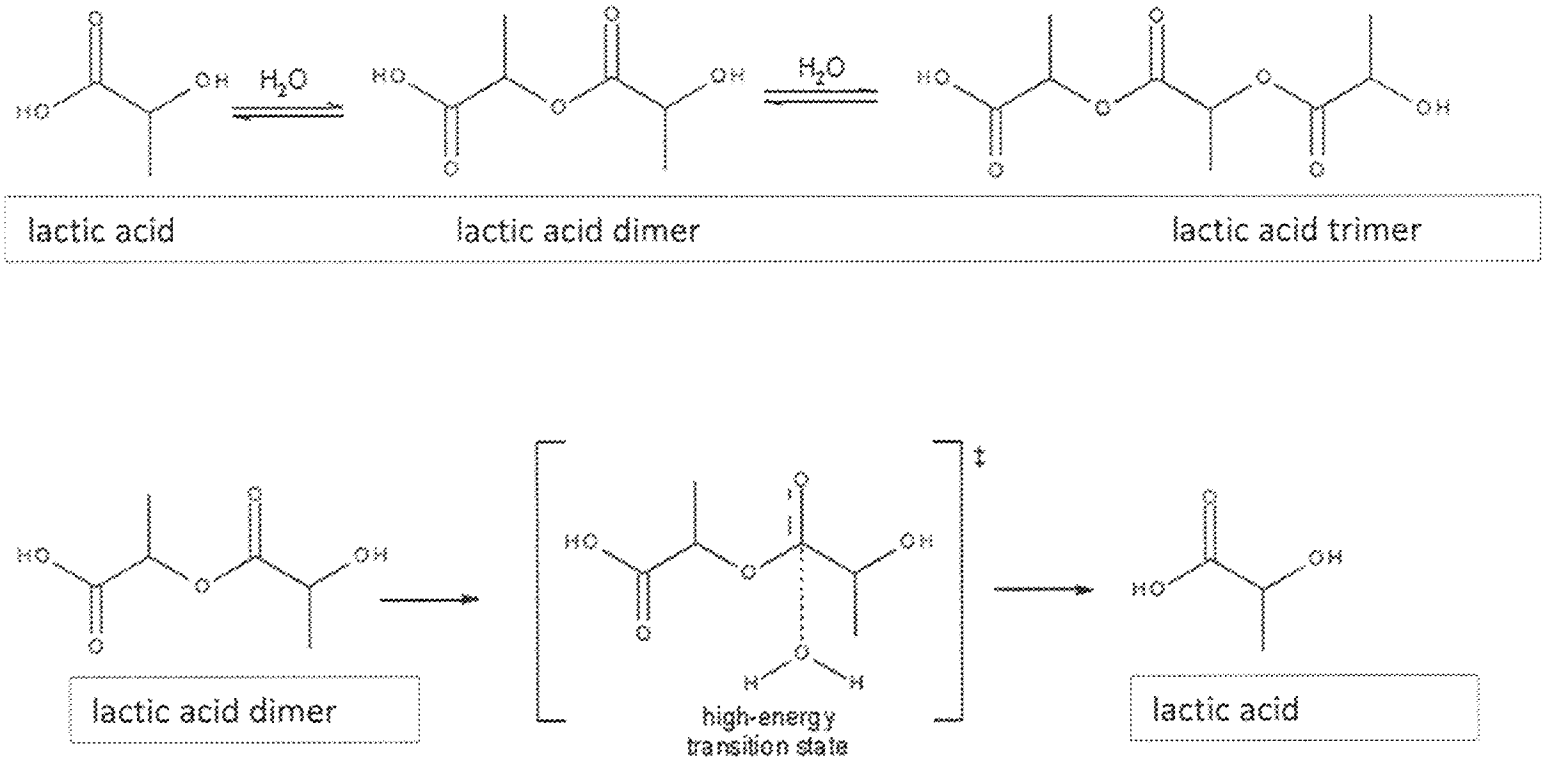
FIG. 1 is a schematic of lactic acid in equilibrium with lactic acid dimer and higher order oligomers/polymers.

The present disclosure will now be described more fully hereinafter with reference to example implementations thereof. These example implementations are described so that this disclosure will be thorough and complete, and will fully convey the scope of the disclosure to those skilled in the art. Indeed, the disclosure may be embodied in many different forms and should not be construed as limited to the implementations set forth herein; rather, these implementations are provided so that this disclosure will satisfy applicable legal requirements. As used in the specification and the appended claims, the singular forms "a," "an," "the" and the like include plural referents unless the context clearly dictates otherwise.

As described hereinafter, the present disclosure relates to methods for preparing aerosol precursor mixtures for use in aerosol delivery systems. In particular, such methods comprise pre-treatment of certain components to be included in the aerosol precursor mixture to give an aerosol precursor that exhibits various desirable characteristics, e.g., ingredient concentrations consistent with targeted concentrations and good shelf stability. In particular, the disclosed methods may provide a relatively high degree of control over the composition and characteristics of the aerosol precursor mixtures.

Generally, aerosol precursors comprise a combination or mixture of various ingredients (i.e., components). The selection of the particular aerosol precursor components, and the relative amounts of those components used, may be modified in order to control the overall chemical composition of the mainstream aerosol produced by an atomizer of an aerosol delivery device. In some embodiments, an aerosol precursor composition can produce a visible aerosol upon the application of sufficient heat thereto (and cooling with air, if necessary), and the aerosol precursor composition can produce an aerosol that can be considered to be "smoke-like." In other embodiments, the aerosol precursor composition can produce an aerosol that can be substantially non-visible but can be recognized as present by other characteristics, such as flavor or texture. Thus, the nature of the produced aerosol can vary depending upon the specific components of the aerosol precursor composition. The aerosol precursor composition can be chemically simple relative to the chemical nature of the smoke produced by burning tobacco.

Of particular interest are aerosol precursors that can be characterized as being generally liquid in nature. For example, representative generally liquid aerosol precursors may have the form of liquid solutions, mixtures of miscible components, or liquids incorporating suspended or dispersed components, which are capable of being vaporized upon exposure to heat under those conditions that are experienced during use of aerosol delivery devices and hence are capable of yielding vapors and aerosols that are capable of being inhaled.

Aerosol precursors generally incorporate a so-called "aerosol former" component. Such materials have the ability to yield visible aerosols when vaporized upon exposure to heat under those conditions experienced during normal use of atomizers that are characteristic of the current disclosure. Such aerosol forming materials include various polyols/polyhydric alcohols (e.g., glycerin, propylene glycol, and mixtures thereof). Many embodiments of the present disclosure incorporate aerosol precursor components that can be characterized as water, moisture or aqueous liquid. During conditions of normal use of certain aerosol delivery devices, the water incorporated within those devices can vaporize to yield a component of the generated aerosol. As such, for purposes of the current disclosure, water that is present within the aerosol precursor may be considered to be an aerosol forming material. For example, aerosol precursor compositions can incorporate mixtures of glycerin and water, or mixtures of propylene glycol and water, or mixtures of propylene glycol and glycerin, or mixtures of propylene glycol, glycerin, and water.

Aerosol precursor compositions further can comprise one or more flavors, medicaments, or other inhalable materials. A variety of flavoring agents or flavor materials that alter the sensory character or nature of the drawn mainstream aerosol can be incorporated as components of the aerosol precursor. Flavoring agents may be added, e.g., to alter the flavor, aroma and/or organoleptic properties of the aerosol. Certain flavoring agents may be provided from sources other than tobacco. Flavoring agents may be natural or artificial in nature, and may be employed as concentrates or flavor packages.

Example flavoring agents include vanillin, ethyl vanillin, cream, tea, coffee, fruit (e.g., apple, cherry, strawberry, peach and citrus flavors, including lime and lemon), floral flavors, savory flavors, maple, menthol, mint, peppermint, spearmint, wintergreen, nutmeg, clove, lavender, cardamom, ginger, honey, anise, sage, cinnamon, sandalwood, jasmine, cascarilla, cocoa, licorice, menthol, and flavorings and flavor packages of the type and character traditionally used for the flavoring of cigarette, cigar and pipe tobaccos. Certain plant-derived compositions that may be used are disclosed in U.S. application Ser. No. 12/971,746 to Dube et al. and U.S. application Ser. No. 13/015,744 to Dube et al., the disclosures of which are incorporated herein by reference in their entireties. Syrups, such as high fructose corn syrup, also can be employed. Certain flavoring agents may be incorporated within aerosol forming materials prior to formulation of a final aerosol precursor mixture (e.g., certain water soluble flavoring agents can be incorporated within water, menthol can be incorporated within propylene glycol, and certain complex flavor packages can be incorporated within propylene glycol).

Flavoring agents also can include acidic or basic characteristics (e.g., organic acids, ammonium salts, or organic amines. Organic acids particularly may be incorporated into the aerosol precursor to provide desirable alterations to the flavor, sensation, or organoleptic properties of medicaments, such as nicotine, that may be combined with the aerosol precursor. For example, organic acids, such as levulinic acid, succinic acid, lactic acid, pyruvic acid, benzoic acid, and/or fumaric acid may be included in the aerosol precursor with nicotine in amounts up to or exceeding being equimolar (based on total organic acid content) with the nicotine. Any combination of organic acids can be used. For example, the aerosol precursor can include about 0.1 to about 0.5 moles of levulinic acid per one mole of nicotine, about 0.1 to about 0.5 moles of pyruvic acid per one mole of nicotine, about 0.1 to about 0.5 moles of lactic acid per one mole of nicotine, or combinations thereof, up to a concentration wherein the total amount of organic acid present is equal to or greater than that amount required to maximize the mono-protonated nicotine content in the aerosol precursor (which can be calculated and is commonly more than an equimolar amount).

In some embodiments, the aerosol precursor comprises a nicotine component. By "nicotine component" is meant any suitable form of nicotine (e.g., free base, mono-protonated, or di-protonated), including in salt form for providing systemic absorption of at least a portion of the nicotine present. Typically, the nicotine component is selected from the group consisting of nicotine free base and a nicotine salt. In some embodiments, nicotine is in its free base form. Nicotine may be tobacco-derived (e.g., a tobacco extract) or non-tobacco derived (e.g., synthetic or otherwise obtained).

For aerosol delivery devices that are characterized as electronic cigarettes, the aerosol precursor can incorporate tobacco or components derived from tobacco. In one regard, the tobacco may be provided as parts or pieces of tobacco, such as finely ground, milled or powdered tobacco lamina. In another regard, the tobacco may be provided in the form of an extract, such as a spray dried extract that incorporates many of the water soluble components of tobacco. Alternatively, tobacco extracts may have the form of relatively high nicotine content extracts, which extracts may also incorporate minor amounts of other extracted components derived from tobacco. In another regard, components derived from tobacco may be provided in a relatively pure form, such as certain flavoring agents that are derived from tobacco. In one regard, a component that is derived from tobacco, and that may be employed in a highly purified or essentially pure form, is nicotine (e.g., pharmaceutical grade nicotine or USP/EP nicotine).

In embodiments of the aerosol precursor material that contain a tobacco extract, including pharmaceutical grade nicotine derived from tobacco, it is advantageous for the tobacco extract to be characterized as substantially free of compounds collectively known as Hoffmann analytes, including, for example, tobacco-specific nitrosamines (TSNAs), including N'-nitrosonornicotine (NNN), (4-methylnitrosamino)-1-(3-pyridyl)-1-butanone (NNK), N'-nitrosoanatabine (NAT), and N'-nitrosoanabasine (NAB); polyaromatic hydrocarbons (PAHs), including benz[a]anthracene, benzo[a]pyrene, benzo[b]fluoranthene, benzo[k]fluoranthene, chrysene, dibenz[a,h]anthracene, and indeno[1,2,3-cd]pyrene, and the like. In certain embodiments, the aerosol precursor material can be characterized as completely free of any Hoffmann analytes, including TSNAs and PAHs. Embodiments of the aerosol precursor material may have TSNA levels (or other Hoffmann analyte levels) in the range of less than about 5 ppm, less than about 3 ppm, less than about 1 ppm, or less than about 0.1 ppm, or even below any detectable limit. Certain extraction processes or treatment processes can be used to achieve reductions in Hoffmann analyte concentration. For example, a tobacco extract can be brought into contact with an imprinted polymer or non-imprinted polymer such as described, for example, in U.S. Pat. No. 9,192,193 to Byrd et al.; and US Pat. Pub. Nos. 2007/0186940 to Bhattacharyya et al; 2011/0041859 to Rees et al.; and 2011/0159160 to Jonsson et al, all of which are incorporated herein by reference. Further, the tobacco extract could be treated with ion exchange materials having amine functionality, which can remove certain aldehydes and other compounds. See, for example, U.S. Pat. Nos. 4,033,361 to Horsewell et al. and 6,779,529 to Figlar et al., which are incorporated herein by reference in their entireties.

The aerosol precursor composition may take on a variety of conformations based upon the various amounts of materials utilized therein. For example, a useful aerosol precursor composition may comprise up to about 98% by weight up to about 95% by weight, or up to about 90% by weight of a polyol. Various polyols are known and can be used in the aerosol precursor compositions, including, but not limited to, glycerin and/or propylene glycol. This total amount can comprise a single polyol (e.g., glycerin or propylene glycol) or can be split in any combination between two or more different polyols. For example, one polyol can comprise about 50% to about 90%, about 60% to about 90%, or about 75% to about 90% by weight of the aerosol precursor, and a second polyol can comprise about 2% to about 45%, about 2% to about 25%, or about 2% to about 10% by weight of the aerosol precursor. A useful aerosol precursor also can comprise up to about 30% by weight, up to about 25% by weight, about 20% by weight or about 15% by weight water—particularly about 0% to about 30%, about 2% to about 30%, about 2% to about 25%, about 5% to about 20%, or about 7% to about 15% by weight water. In some embodiments, aerosol precursor compositions have no water intentionally added (or only a very small amount, such as up to about 2%). Flavors and the like (which can include medicaments, such as nicotine) can comprise up to about 10%, up to about 8%, or up to about 5% by weight of the aerosol precursor. Typically, although not limited thereto, flavor compounds other than nicotine can be present at ppm or μg/g levels or about 0.004% to about 0.1%; some flavor compounds other than nicotine, such as menthol, can be present at higher levels, e.g., up to about 4% by weight (e.g., between about 1.5% and about 3% by weight) based on the aerosol precursor. Further, where menthol is used, the amount of water may, in some embodiments, desirably be minimized so as not to result in precipitation of the menthol. In some embodiments, the flavors are included within the aerosol precursor solution in the form of an aerosol former solution (e.g., in a water, propylene glycol, and/or glycerin solution), and in such embodiments, the flavor-containing aerosol former solution can be employed in an amount of about 5% to about 10% by weight based on the total aerosol precursor weight, wherein the one or more flavors can be included in various concentrations therein.

As a non-limiting example, an aerosol precursor according to some embodiments can comprise glycerol, propylene glycol, water, nicotine, and one or more flavors. Specifically, the glycerol can be present in an amount of about 70% to about 90% by weight, about 70% to about 85% by weight, about 70% to about 80%, or about 75% to about 85% by weight, the propylene glycol can be present in an amount of about 1% to about 10% by weight, about 1% to about 8% by weight, or about 2% to about 6% by weight, the water can be present in an amount of about 1% to about 30% by weight, such as about 1% to about 25% by weight, about 1% to about 10% by weight, about 1% to about 5%, about 10% to about 25% by weight, about 10% to about 20% by weight, about 12% to about 20% by weight, about 12% to about 16% by weight, the nicotine can be present in an amount of about 0.1% to about 7% by weight, about 0.1% to about 5% by weight, about 0.5% to about 4% by weight, or about 1% to about 3% by weight, and the flavors can be present in an amount of up to about 5% by weight, up to about 3% by weight, or up to about 1% by weight, all amounts being based on the total weight of the aerosol precursor. One specific, non-limiting example of an aerosol precursor comprises about 75% to about 80% by weight glycerol, about 13% to about 15% by weight water, about 4% to about 6% by weight propylene glycol, about 2% to about 3% by weight nicotine, and about 0.1% to about 0.5% by weight flavors. The nicotine, for example, as referenced above, can be from a tobacco extract or can be non-tobacco-derived/synthetic.

Another non-limiting example comprises a greater amount of propylene glycol, e.g., about 15% to about 40%, such as about 15% to about 30% or about 25% to about 35% by weight, with the glycerol present in a lower amount than in the above non-limiting example, such as about 40% to about 70% by weight or about 50% to about 70%, the water can be present in an amount of about 5% to about 20% by weight, about 10% to about 18% by weight, or about 12% to about 16% by weight, the nicotine can be present in an amount of about 0.1% to about 7% by weight, about 0.1% to about 5% by weight, about 0.5% to about 4% by weight, or about 1% to about 3% by weight, and the flavors can be present in an amount of up to about 5% by weight, up to about 3% by weight, or up to about 1% by weight, all amounts being based on the total weight of the aerosol precursor.

Representative types of aerosol precursor components and formulations are also set forth and characterized in U.S. Pat. No. 7,726,320 to Robinson et al. and U.S. Pat. Pub. Nos. 2013/0008457 to Zheng et al.; 2013/0213417 to Chong et al. and 2014/0060554 to Collett et al., 2015/0020823 to Lipowicz et al.; and 2015/0020830 to Koller, as well as WO 2014/182736 to Bowen et al, the disclosures of which are incorporated herein by reference. Additional aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. Example aerosol precursor compositions also include those types of materials incorporated within devices available through Atlanta Imports Inc., Acworth, Ga., USA., as an electronic cigar having the brand name E-CIG, which can be employed using associated Smoking Cartridges Type C1a, C2a, C3a, C4a, C1b, C2b, C3b and C4b; and as Ruyan Atomizing Electronic Pipe and Ruyan Atomizing Electronic Cigarette from Ruyan SBT Technology and Development Co., Ltd., Beijing, China.

Other aerosol precursors that may be employed include the aerosol precursors that have been incorporated in the VUSE® product by R. J. Reynolds Vapor Company, the BLU™ product by Lorillard Technologies, the MISTIC MENTHOL product by Mistic Ecigs, and the VYPE product by CN Creative Ltd. Also desirable are the so-called "smoke juices" for electronic cigarettes that have been available from Johnson Creek Enterprises LLC. Embodiments of effervescent materials can be used with the aerosol precursor, and are described, by way of example, in U.S. Pat. App. Pub. No. 2012/0055494 to Hunt et al., which is incorporated herein by reference. Further, the use of effervescent materials is described, for example, in U.S. Pat. No. 4,639,368 to Niazi et al.; U.S. Pat. No. 5,178,878 to Wehling et al.; U.S. Pat. No. 5,223,264 to Wehling et al.; U.S. Pat. No. 6,974,590 to Pather et al.; and U.S. Pat. No. 7,381,667 to Bergquist et al., as well as US Pat. Pub. Nos. 2006/0191548 to Strickland et al.; 2009/0025741 to Crawford et al; 2010/0018539 to Brinkley et al.; and 2010/0170522 to Sun et al.; and PCT WO 97/06786 to Johnson et al., all of which are incorporated by reference herein.

Formulations such as aerosol precursors are generally formulated based on listed purities and/or analyses to account for impurities that may be present in an as-provided sample. As used herein, a "purity" less than 100% is used to indicate the presence of compound(s) other than the compound listed on the label (excluding reaction products of that compound, e.g., dimers, trimers, oligomers, etc., and excluding any solvent that may be present in the sample, such as where the compound is provided in a diluted solution form). As a simplified theoretical example, it can reasonably be considered that, if a sample is indicated to be 95% pure lactic acid by weight, then to obtain an aerosol precursor formulation with 20 g of lactic acid, one should incorporate 21.1 g lactic acid to account for the purity below 100%. The inventors have found generally that samples of commercially available organic acids in particular actually contain less (and, in some cases, significantly less) than the listed percentage of the organic acid monomer, and typically comprise (in addition to the listed monomeric acid) some percentage of reaction products, including, but not limited to, acid dimers, oligomers, polymers and other compounds. As such, within certain samples designated as organic acids, the listed acid monomer commonly exists in equilibrium with other species, with the acid monomer itself accounting for less than 100% of the total content of organic acid listed on the label. The term "purity" is understood herein to be distinguished from "label strength," which may include a solvent, e.g., water (e.g., in the case of an acid solution sample with label strength 95% acid, which contains 95% acid and 5% water by weight).

FIG. 1 shows common reaction products for lactic acid (including the lactic acid dimer shown, which is commonly referred to as "lactoyllactic acid" or "lactic acid lactate"). The presence of compounds (e.g., dimers, trimers, oligomers, and polymers) other than the organic acid itself (i.e., other than the acid monomer) can, in turn, lead to a final formulation (e.g., aerosol precursor) that does not contain the desired content of monomeric organic acid (calculated assuming 100% of the organic acid added is in monomeric form). In particular, such compounds (other than the acid monomer) may result in a decrease of the effective acidity (e.g., where two lactic acid molecules (each with one acid functionality) combine as shown to produce a dimer with only one (or no) acidic functionality, reducing the number of associated acid functionalities from two to one or zero).

"Acid monomer," and references to the "monomeric form" as used herein are intended to refer to the acid itself, e.g., the compound listed on the label of a commercial sample (typically comprising a single acid functionality, which can be protonated or unprotonated, depending, e.g., on the pH of the solution). The term "acid monomer" further is intended to include monomeric acids in salt form, e.g., where the hydrogen ion (in the form of H+ or a proton) of the acid is transferred to a moiety of another component in the aerosol precursor (e.g., including, but not limited to, nicotine, producing mono-protonated nicotine), e.g., in the form of nicotine salts. "Acid monomer" as used herein expressly excludes moieties comprising other acid reaction products, e.g., the dimers, trimers, oligomers, and polymers referenced above.

References to the "dimer," "trimer," "oligomer," and "polymer" forms of a given acid are understood, in the context of the present application (unless otherwise specified) to encompass reaction products of the acid monomer (with other acid monomers or with other moieties), which may have fewer available acid moieties than present in the sum of the constituent acid monomers. For example, certain dimers of particular concern according to the present disclosure are produced from two monomers (each comprising one acid functionality), wherein the resulting dimer only contains one (or fewer) acid functionalities; trimers of particular concern according to the present disclosure are produced from three monomers (each comprising one acid functionality), wherein the trimer contains two (or fewer) acid functionalities. Correspondingly, oligomers of particular concern can be described as being produced from "x" monomers (each comprising one acid functionality), wherein the oligomer contains fewer than "x" acid functionalities. This discussion focuses on dimers, trimers, and oligomers produced from monomers containing one acid functionality each; however, it is understood that, by extension, this discussion is applicable also to dimers, trimers, and oligomers produced from monomers containing more than one acid functionality. For example, in the context of dimers, trimers, oligomers, and polymers formed from monomers with two acid functionalities each, of particular concern are dimers containing fewer than four acid functionalities, trimers containing fewer than six acid functionalities, and the like, resulting in the overall decrease of acid functionalities with respect to the corresponding acid monomer form. The presence of less than the expected content of an acid monomer due to the presence of dimers, trimers, oligomers, and polymers within a given sample can have negative consequences, e.g., when calculating an amount of that sample to be added for reaction with another component or to be added to provide a desired amount of acidity.

To address the discrepancy noted by the inventors in the amount of acid monomer listed and actually present in organic acid samples (due to the presence of reaction products as referenced herein above, e.g., acid dimers, trimers, oligomers, and polymers), the present disclosure provides a method in which certain components of the aerosol precursor are pre-treated prior to formulation of the aerosol precursor. Such pre-treatment of a component may, in some embodiments, ensure a higher percentage of the desired component in the formulation into which it is incorporated (e.g., an amount more reflective of the labeled/desired amount). In the context of the acids referenced above, such pre-treatment can, in some embodiments, advantageously provide an amount of acid monomer within the formulation which is more reflective of the labeled content of that acid. In other words, such pre-treatment desirably decreases reaction products of the acid in a sample (e.g., dimeric, trimeric, oligomeric, and polymeric species formed from the acid monomer). The resulting pre-treated acid sample can be characterized as comprising a higher molar amount of acid monomer than a comparable untreated acid sample. As such, in preferred embodiments, the calculated amount of pre-treated "acid" to be incorporated into a formulation is more closely aligned with the amount of acid monomer actually present in that formulation as compared with a formulation including the same amount of "acid" in untreated form (which has been incorporated directly into the formulation). As such, the disclosed method provides a method for the preparation of formulations, e.g., aerosol precursors, with amounts of the one or more organic acids that are closer to the targeted amounts of the one or more organic acids than would be provided without the pre-treatment described herein.

The pre-treatment method generally comprises hydrolysis of the one or more organic acid samples. Hydrolysis is understood to be reaction with water. In the context of the disclosed hydrolysis of organic acids, hydrolysis generally comprises combining the one or more organic acid samples with water to push the equilibrium toward monomeric acid. An example is provided in FIG. 1, depicting hydrolysis of lactic acid in equilibrium with a lactic acid dimer and higher order oligomeric reaction products. According to the present disclosure, organic acid samples are subjected to hydrolysis to promote an equilibrium shift toward the monomeric organic acid form (e.g., "lactic acid" in the example shown in FIG. 1).

Hydrolysis can be conducted in various manners. In some embodiments, the hydrolysis pre-treatment comprises one or both of diluting the one or more organic acid samples in water and subjecting the diluted samples to elevated temperatures. In some embodiments, the method comprises selecting a dilute solution of an organic acid in water (rather than a more concentrated solution) for inclusion within a formulation as described herein. As such, the hydrolysis in some embodiments occurs in situ, while in other embodiments, the hydrolysis occurs by modifying the as-received sample (e.g., by adding water thereto or otherwise diluting the sample).

Diluting an organic acid sample generally comprises adding water to the sample or otherwise contacting the sample with water to decrease the overall concentration of compounds (other than water) in the sample. The result is a diluted aqueous solution. Although water is typically employed in the production of the diluted aqueous solution, other solvents can be used in combination with water, e.g., to ensure solubility. Other solvents can include, but are not limited to, solvents that are miscible with water, such as alcohols (e.g., methanol, ethanol, isopropanol, etc.), tetrahydrofuran, and acetone. Such solvents may require removal before complete formulation and packaging of the aerosol precursor composition.

The extent of dilution can vary, and it is not believed there is a true "minimum" dilution needed to provide some degree of result (e.g., hydrolysis of acid dimers, trimers, oligomers, and/or polymers) as disclosed herein. Typically, it has been found that, with some limitation, the higher the water content, the higher the monomer acid content after hydrolysis. As such, in some embodiments, higher dilutions can be advantageous to promote monomer formation. It is noted that, for a high degree of hydrolysis, sufficient water must be used to react with all compounds in the acid sample other than the acid monomer to produce acid monomer. Further, sufficient water must typically be used to ensure the water can access all compounds in the acid sample other than the acid monomer to produce acid monomer. As such, although the water content is not particularly limited, these considerations are relevant in determining an appropriate dilution. In some embodiments, dilution provides a diluted sample that is at least 1% water by weight, at least about 5% water by weight, at least about 10% water by weight, at least 20% water by weight, at least 30% water by weight, at least 40% water by weight, at least 50% water by weight, at least 60% water by weight, or at least 70% water by weight (e.g., including, but not limited to, about 10% to about 80% water by weight). In some embodiments, dilution provides a diluted sample that is about 50-90% water by weight.

It is noted that reference is made in the foregoing paragraphs to "dilution"; however, in some embodiments, dilution is not an affirmative "step" of the process actively undertaken; in some embodiments, it may be suitable to purchase and use a dilute solution (rather than a more concentrated sample), as hydrolysis can occur within certain dilute solutions over a period of time, providing a suitable monomeric acid content. In some embodiments, the method can comprise purchasing a dilute solution and maintaining/storing it for a period of time sufficient to ensure the desired extent of hydrolysis before use.

The conditions to which the acid-containing solution is subjected can, in some embodiments, have an effect on the rate of hydrolysis. For example, hydrolysis will likely be more rapid for a solution subjected to hydrolysis at a temperature of 40° C. than that for a solution subjected to hydrolysis at a temperature of 25° C. As such, the pre-treatment/hydrolysis disclosed herein is, in some embodiments, temperature-dependent. The hydrolysis is also, in some embodiments, dependent upon the concentration of the solution subjected to hydrolysis. As would be recognized by one of skill in the art, sufficient water must be present within the solution to react with any acid reaction product (thus forming the acid monomer, as desired). In some embodiments, a more dilute solution can undergo hydrolysis at a faster rate than a more concentrated solution. Although not intending to be limited by theory, it is believed that higher water content of the solution and/or higher temperature conditions results in greater/faster hydrolysis, affording more acid monomer.

In some embodiments, hydrolysis is conducted, at least in part, at room temperature. In other embodiments, the hydrolysis is conducted, at least in part, at elevated temperature. The elevated temperature to which the diluted organic acid sample is subjected during the hydrolysis pre-treatment can vary. The temperature may affect the time required to achieve a particular percent acid in the sample. Higher temperatures typically provide faster reaction. As such, at higher temperature, the hydrolysis pre-treatment disclosed herein may result in a higher total acid monomer percentage in solution than the same reaction conducted at lower temperature for the same period of time. Similarly, at higher temperature, the hydrolysis pre-treatment may require less time than the same reaction conducted at lower temperature to achieve the same total acid monomer percentage in solution.

However, the hydrolysis can be conducted at various temperatures, including around ambient temperature (e.g., about 25° C.), at elevated temperature (greater than about 25° C.), and even at cooled temperatures (e.g., less than about 25° C.). In particular embodiments, the hydrolysis pre-treatment comprises heating the diluted samples at a temperature of about 30° C. or greater, a temperature of about 40° C. or greater, a temperature of about 50° C. or greater, a temperature of about 60° C. or greater, a temperature of about 70° C. or greater, a temperature of about 80° C. or greater, a temperature of about 90° C. or greater, or a temperature of about 100° C. or greater. For example, in some embodiments, the hydrolysis pre-treatment is conducted at a temperature within the range of about 30° C. to about 100° C., about 40° C. to about 100° C., e.g., about 30° C. to about 80° C. or about 50° C. to about 100° C. In certain specific embodiments, the hydrolysis is conducted at about 40° C. and in other specific embodiments, the hydrolysis is conducted at about 70° C. In some embodiments, the hydrolysis reaction may be exothermic and thus, the temperature of the solution may fluctuate somewhat during pre-treatment, even without the direct application of heating or cooling means.

The maximum temperature at which the hydrolysis is conducted is limited, e.g., by the temperature at which the acid monomer boils and/or degrades. For example, where the acid is lactic acid, the upper limit of the temperature to which the solution is exposed during the hydrolysis step is below the minimum degradation temperature of the acid monomer (about 130° C.) and typically also below the boiling point of the acid monomer (about 127° C.).

Such hydrolysis pre-treatment can be conducted over varying periods of time and, as noted above, the period of time is dependent, e.g., on the initial content of monomer form present (prior to beginning hydrolysis treatment), the desired content of acid monomer, and on the temperature at which the hydrolysis is conducted. It is understood that, in some embodiments, the time for which the solution is subjected to hydrolysis is about 2 hours to about 144 hours, such as about 6 hours to about 48 hours. In some embodiments, the time period is significantly longer, e.g., on the order of days, weeks, or months, e.g., where the solution is not heated.

The solution subjected to hydrolysis can, in some embodiments be stirred, shaken, or otherwise agitated before, during, and/or after the hydrolysis. However, this is not required and, in some embodiments, the diluted solution is simply left to sit without intentional movement. The solution subjected to hydrolysis is typically maintained at atmospheric pressure; however, the pressure can, in some embodiments be varied. For example, in some embodiments, hydrolysis is conducted at elevated pressure (greater than atmospheric pressure). The relationship between temperature and pressure is generally understood and in some embodiments, pressure can be modified to obtain results at a lower temperature that are comparable to those obtained using a given temperature. The composition of the atmosphere surrounding the solution being subjected to hydrolysis can vary as well and is not intended to be limited.

Hydrolysis in this context generally provides greater acid monomer content, and can thus affect the pH in some embodiments. For example, in some embodiments, as dimers having a single acid functionality are hydrolyzed to monomeric acids, the amount of acid functionalities will increase, which can affect the pH of the overall sample. Evaluation of the acidity may therefore be indicative of the extent of hydrolysis. As such, in some embodiments, the method comprises monitoring pH of the solution. The desired pH range can vary and, in some embodiments, may depend on the specific product into which the solution is designed to be incorporated.

Hydrolysis can also be monitored or evaluated, e.g., by measuring the refractive index or specific gravity of the solution being treated. Evaluation of either or both of these parameters can be indicative of the extent of hydrolysis. Generally, as dimers having a single acid functionality are hydrolyzed to monomeric acids, the refractive index and the specific gravity of the solution will increase. As such, in some embodiments, the method comprises monitoring the refractive index and/or specific gravity (via methods known in the art) to evaluate the extent of hydrolysis. Typically, when plotting values over time, following an initial increase in the refractive index and/or specific gravity, the values level off and do not change significantly, which can, in some embodiments, signify sufficient hydrolysis (e.g., complete or nearly complete conversion of dimers, trimers, oligomers, and polymers to acid monomers).

As outlined herein, the resulting solution, after pre-treatment by hydrolysis, advantageously contains a higher overall amount of acid monomer than the solution prior to the pre-treatment by hydrolysis (e.g., on a dry weight basis). Advantageously, the pre-treated solution comprises a relatively low amount of other acid-derived components, including, but not limited to, acid dimers, acid trimers, acid oligomers, acid polymers, and reaction products. In some embodiments, the acid monomer content of the pre-treated solution is closer to the indication on the label of the purity of the as-purchased product than prior to this pre-treatment. For example, a bottle labeled as being 90% pure may initially comprise less than 80% of the monomeric acid, e.g., less than 80% of the acid is in monomeric form, and after pre-treatment, that same solution may comprise ~80% or more of the monomeric acid (e.g., about 80% to about 90% of the solution by dry weight comprises the acid in monomeric form).

In some embodiments, the acid monomer content in the hydrolyzed solution is reported in percent dry weight (i.e., without water content). It is understood that the maximum dry weight of an acid monomer in a given sample is limited by its purity, where a purity of less than 100% is indicative of impurities other than solvent and other than acid monomers, dimers, trimers, oligomers, and polymers. In other words, the maximum dry weight of monomer after hydrolysis is generally closer to the dry weight of monomer indicated by the labeled purity but typically does not exceed the dry weight of monomer indicated by the purity. For example, a sample with a purity of 85% acid may initially comprise about 75% acid monomer by dry weight, about 10% acid reaction products by dry weight (e.g., dimers, trimers, oligomers, polymers, etc.) and about 15% impurities by dry weight. After the pre-treatment described herein, the sample advantageously comprises greater than 75% acid monomer by dry weight (e.g., greater than 80%, including close to or substantially equal to the content indicated by purity, e.g., 85%).

In some embodiments, the hydrolyzed solution (following the pretreatment step described herein) comprises at least about 75% acid monomer, at least about 80% acid monomer, at least about 85% acid monomer, at least about 90% acid monomer, or at least about 95% acid monomer by dry weight. As referenced above, it is understood that the maximum dry weight of the acid monomer provided upon hydrolysis will depend, at least in part, on the purity of the initial sample (given that purity is understood to encompass components other than solvent/water). For example, if a sample is used that is reported as 90% purity of a given acid by dry weight, it is not reasonable to obtain a hydrolyzed sample with greater than 90% acid monomer by dry weight. In some embodiments, the amount of acid monomer is described by comparison to the stated purity of the sample subjected to hydrolysis. For example, the solution after pre-treatment by hydrolysis can contain a dry weight percentage of acid monomer within about 10% of the stated purity (e.g., for an acid sample indicated to have 90% purity, it is possible to obtain, after hydrolysis, a hydrolyzed solution with about 81% to about 90% acid monomer by dry weight, such as about 85% to about 90% acid monomer by dry weight, about 87% to about 90% acid monomer by dry weight, or about 88% to about 90% acid monomer by dry weight). In other embodiments, the solution after pre-treatment by hydrolysis can contain a dry weight percentage of acid monomer within about 9% of the listed purity, within about 8% of the listed purity, within about 7% of the listed purity, within about 6% of the listed purity, within about 5% of the listed purity, within about 4% of the listed purity, within about 3% of the listed purity, within about 2% of the listed purity, or within about 1% of the listed purity.

In certain embodiments, the molar increase in acid monomer is significant, particularly in the context of lactic acid. For example, one particular sample indicated to be "85% lactic acid" label strength (i.e., assumed to contain 85% lactic acid and 15% water by weight) was found to contain only about 60-70% lactic acid monomer; upon hydrolysis, the monomer content was increased such that the final sample comprised 88% to 100%, e.g., greater than 90% or greater than 95% on dry weight basis. It is noted that this example does not provide a direct comparison (as "label strength" (used to describe the original sample) is based on total weight (including solvent, etc.), while "dry weight basis" (used to describe the pre-treated/hydrolyzed sample) is based on dry weight only (excluding solvent, etc.). The samples are referred to differently as typically, water is added to the original solution to promote hydrolysis (as outlined herein above); as such, the comparable "label strength" of the pre-treated sample after hydrolysis would, in many embodiments, be actually lower than that of the untreated sample (due to the dilution).

Certain other acids (e.g., levulinic and benzoic acid) may benefit from the hydrolysis process disclosed herein, but typically do not exhibit such a significant change in monomer content as evidenced for lactic acid.

Following hydrolysis, the hydrolyzed ("pre-treated") solution can be processed in various ways. Advantageously, the hydrolyzed solution is treated in a manner so as to minimize/prevent the re-formation of dimers, trimers, oligomers, polymers etc. For example, the hydrolyzed/pre-treated solution is typically not subjected to conditions following the hydrolysis as described herein that may drive the reaction of acid monomer toward a dimer (or other unwanted) product). In some embodiments, the pre-treated solution is used in the dilute hydrolyzed solution form. In other embodiments, it is further processed, e.g., to remove at least some water therefrom (providing a less dilute solution), including to remove substantially all water therefrom (providing the neat acid). Such concentration can be conducted, e.g., via a freeze drying process as is known in the art. Again, it is beneficial to avoid subjecting the solution to conditions that may be expected to form reaction products and decrease the acid monomer content. A neat acid can then be used directly or can be dissolved in another solvent for incorporation within a formulation.

The resulting hydrolyzed acid (in solution form or in neat form) is then incorporated within the desired formulation(s). Advantageously, the hydrolysis is conducted shortly before the solution is incorporated into the formulation so as to maintain the acid in acid monomer form. As such, in some embodiments, the hydrolyzed solution is preferably not subjected to storage for any significant length of time. For example, it can be advantageously used in a formulation within about one month, within about three weeks, within about two weeks, within about one week, within about 5 days of the time the hydrolysis conditions are ended. However, in some embodiments (e.g., where the hydrolyzed acid is kept in aqueous solution and/or kept at ambient temperature and/or maintained under high relative humidity conditions), the storage time may be increased. Generally, the higher the water content in the environment in which the hydrolyzed acid is kept, the less able the acid is to dimerize. As such, in some embodiments, a pre-treated/hydrolyzed acid solution can be stored for six months or more and exhibit substantial stability (maintaining substantially the same acid monomer content after the pre-treatment is conducted).

Figure 2:
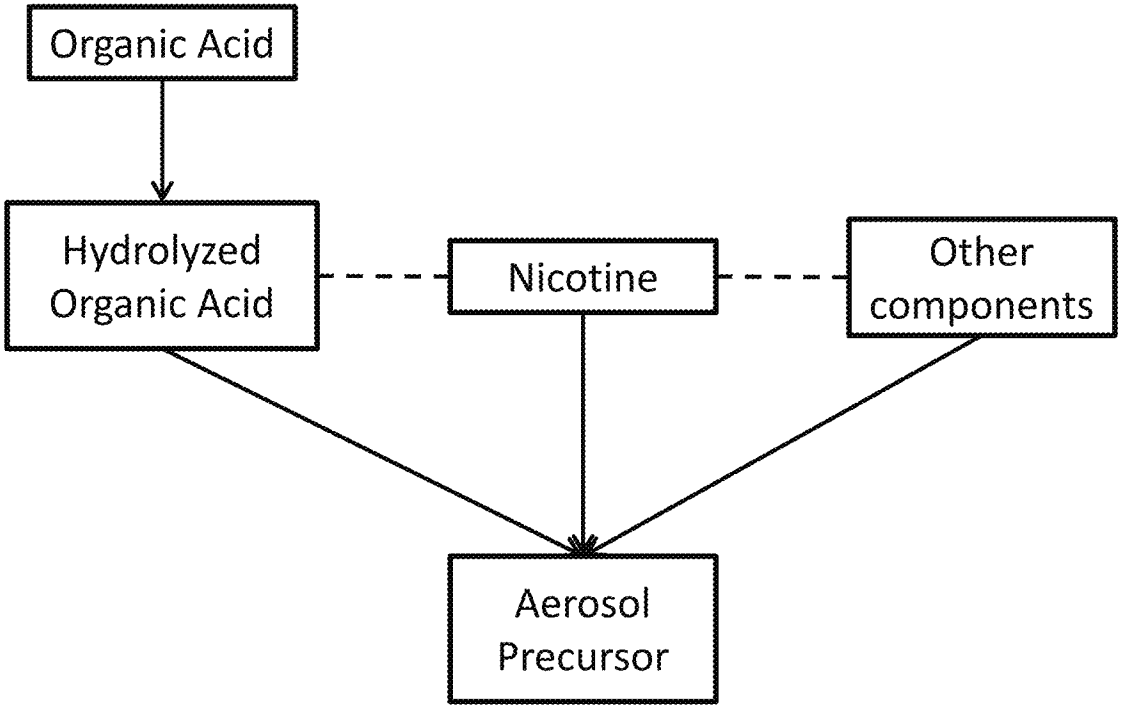
FIG. 2 is a flow chart of method steps of one embodiment of the disclosed method.

To form the desired formulation (e.g., aerosol precursor), the components to be included in the formulation can be combined in any order. In some embodiments, the hydrolyzed acid is combined first with nicotine, as disclosed, for example, in U.S. application Ser. No. 15/792,120 to RAI Strategic Holdings, Inc., filed Oct. 24, 2017, which is incorporated herein by reference in its entirety. In other embodiments, components are added one by one; in some embodiments, two or more components are combined and other components are added thereto, and in some embodiments, all components are substantially simultaneously combined. Additional components can be added independently or as mixtures of one or more such components. The additional components can be incorporated by any means known in the art, and in various amounts. Mixing of any or all components can be conducted between each addition, where multiple components are added separately, and/or once all components are combined. FIG. 2 depicts a general process for the production of an aerosol precursor, wherein one or more "Organic Acid" components is pre-treated as disclosed herein to give a "Hydrolyzed Organic Acid." The "Hydrolyzed Organic Acid," "Nicotine," and "Other Components" can be independently combined (as shown by the arrows) to give an Aerosol Precursor, or any two or more such components can be mixed first (as depicted by the dashed lines). Heating and/or agitation can be used at any step of the process, e.g., to promote dissolution/mixing. In one embodiment, the preparation of a formulation comprising a pre-treated acid is conducted in the absence of the application of heat, e.g., the method is done at room temperature, although the disclosure is not limited thereto.

The components to be incorporated within the desired formulation can vary. Where the formulation is an aerosol precursor, compounds such as those referenced herein above as "aerosol former" components may be included. The disclosed method can further comprise adding one or more additional components desired in the final aerosol precursor, such as flavorants. In one embodiment, nicotine and one or more pre-treated organic acids (which have been subjected to hydrolysis) are combined in water to create an aqueous solution and, subsequently, one or more flavorants are added thereto, and then one or more aerosol formers (e.g., polyols/polyhydric alcohols) are added to produce an aerosol precursor.

The resulting formulation is generally an aqueous solution. By "aqueous solution" is meant a liquid wherein at least part of the solvent comprises water. The components of an aerosol precursor composition are typically fully dissolved, although the disclosure is not limited thereto, and it is possible to employ mixtures wherein at least a portion of one or more of the components thereof are not completely dissolved, e.g., wherein some solid is dispersed within a liquid phase. It is noted that, in such embodiments, the formulation may optionally be further processed, e.g., via filtration, centrifugation, or the like to remove solid material.

Advantageously, by subjecting the one or more acid components to be included in the formulation to hydrolysis pre-treatment, an aerosol precursor formulation with an organic acid(s) content that approximates the intended amount of organic acid(s) in the aerosol precursor can be obtained. For example, an amount "A" of an organic acid is calculated to ideally provide a desired weight percent "x" of Organic Acid A in the aerosol precursor, and thus, an amount "A" of the organic acid is used in the disclosed method. Advantageously, based on the disclosed method, the actual weight percent of Organic Acid A in the aerosol precursor does not deviate significantly from "x," due to the pre-treatment of the organic acid before inclusion. For example, in some embodiments, the concentration of one or more organic acids in the aerosol precursor is no more than about 25% less than targeted (calculated assuming 100% acid monomer), no more than about 20% less than targeted, no more than about 10% less than targeted, or no more than about 5% less than targeted. Where more than one different organic acid is used in the disclosed method, each organic acid can independently meet these limitations and/or the organic acids combined can meet these limitations. For example, in some embodiments, the concentration of one or more of the organic acids in the aerosol precursor is independently no more than about 25% less than targeted, no more than about 20% less than targeted, no more than about 10% less than targeted, or no more than about 5% less than targeted and/or the total concentration of organic acids in the aerosol precursor is no more than about 25% less than targeted, no more than about 20% less than targeted, no more than about 10% less than targeted, or no more than about 5% less than targeted.

The method of the disclosure, leading to a formulation with an amount of acid monomer closer to the targeted amount in the aerosol precursor, provides certain benefits. For example, it is understood that organic acids in an aerosol precursor can be advantageous in ensuring protonation of at least a portion of the nicotine present in the aerosol precursor. Such protonation desirably leads to an aerosol produced from the precursor that provides low to mild harshness in the throat of the user. It is generally understood that if too little acid is included within an aerosol precursor, a larger amount of nicotine will remain unprotonated and in the gas phase of the aerosol, the user will experience increased throat harshness. See, e.g., US Pat. Appl. Publ. No. 20150020823 to Lipowicz et al., which is incorporated herein by reference. As such, the methods of various embodiments, which can provide an amount of organic acid(s) in an aerosol precursor that is close to the target amount, can lead to desirable sensory/taste characteristics (e.g., decreased harshness).

In some embodiments, the pH of the aerosol precursor can be maintained within a desired range. Again, by limiting the presence of compounds other than acid monomer contributed by addition of the one or more "organic acids," the target pH of the aerosol precursor may be more accurately obtained. In some embodiments, the method disclosed herein additionally provides an aerosol precursor with decreased impurities (i.e., decreased amounts of compounds other than those targeted for inclusion within the formulation, such as acid dimers, oligomers, polymers, and reaction products). Generally, the disclosed method may provide enhanced control over the composition (e.g., amount of organic acid(s), amount of undesirable impurities, etc.) and characteristics (e.g., pH, stability) of the aerosol precursor composition produced thereby. Based on the disclosure herein, it is noted that the pre-treatment/hydrolysis can be described as providing formulary control.

Although "dilution" is referenced as a step of the disclosed method provided herein above, it is noted that, in some embodiments, dilution is not required, i.e., where a sample is purchased in diluted form (e.g., diluted in water). For example, acid solutions can be purchased (e.g., including, but not limited to, 50% solutions of acids). In some embodiments, use of such samples can avoid the need for the dilution step and/or the hydrolysis step referenced herein. In the aqueous solution form, it is believed a greater content of the acid is in the desired monomer form, and thus, little to no hydrolysis may be required using such a sample to provide a percentage of monomer form close to the labeled acid content. In such embodiments, by factoring in the water content of the diluted sample (e.g., the commercially available acid solution), the final aerosol precursor can be prepared by combining the diluted sample directly with the one or more additional components desired in the final aerosol precursor (and any water needed to make up the total desired water content thereof).

The disclosed method can further comprise incorporating the aerosol precursor within an aerosol delivery system, as generally known in the art. Aerosol delivery systems generally use electrical energy to heat a material (preferably without combusting the material to any significant degree) to form an inhalable substance; and components of such systems have the form of articles most preferably are sufficiently compact to be considered hand-held devices. That is, use of components of preferred aerosol delivery systems does not result in the production of smoke in the sense that aerosol results principally from by-products of combustion or pyrolysis of tobacco, but rather, use of those preferred systems results in the production of vapors resulting from volatilization or vaporization of certain components incorporated therein. In some example implementations, components of aerosol delivery systems may be characterized as electronic cigarettes, and those electronic cigarettes most preferably incorporate tobacco and/or components derived from tobacco, and hence deliver tobacco derived components in aerosol form. Aerosol delivery systems into which aerosol precursors prepared as disclosed herein can be incorporated also can be characterized as being vapor-producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like.

Aerosol delivery systems generally include a number of components provided within an outer body or shell, which may be referred to as a housing. The overall design of the outer body or shell can vary, and the format or configuration of the outer body that can define the overall size and shape of the aerosol delivery device can vary. Typically, an elongated body resembling the shape of a cigarette or cigar can be a formed from a single, unitary housing or the elongated housing can be formed of two or more separable bodies. For example, an aerosol delivery device can comprise an elongated shell or body that can be substantially tubular in shape and, as such, resemble the shape of a conventional cigarette or cigar. In one example, all of the components of the aerosol delivery device are contained within one housing. Alternatively, an aerosol delivery device can comprise two or more housings that are joined and are separable. For example, an aerosol delivery device can possess at one end a control body comprising a housing containing one or more reusable components (e.g., an accumulator such as a rechargeable battery and/or capacitor, and various electronics for controlling the operation of that article), and at the other end and removably coupleable thereto, an outer body or shell containing a disposable portion (e.g., a disposable flavor-containing cartridge). See also the types of devices set forth in U.S. patent application Ser. No. 15/708,729 to Sur et al., filed Sep. 19, 2017 and U.S. patent application Ser. No. 15/417,376 to Sur et al., filed Jan. 27, 2017, which are incorporated herein by reference in their entireties.

Aerosol delivery systems of the present disclosure most preferably comprise some combination of a power source (i.e., an electrical power source), at least one control component (e.g., means for actuating, controlling, regulating and ceasing power for heat generation, such as by controlling electrical current flow the power source to other components of the article—e.g., an analog electronic control component), a heater or heat generation member (e.g., an electrical resistance heating element or other component, which alone or in combination with one or more further elements may be commonly referred to as an "atomizer"), an aerosol precursor composition (e.g., commonly a liquid capable of yielding an aerosol upon application of sufficient heat, such as ingredients commonly referred to as "smoke juice," "e-liquid" and "e-juice"), and a mouthend region or tip for allowing draw upon the aerosol delivery device for aerosol inhalation (e.g., a defined airflow path through the article such that aerosol generated can be withdrawn therefrom upon draw).

The selection and arrangement of various aerosol delivery system components can be appreciated, e.g., upon consideration of the commercially available electronic aerosol delivery devices, such as those representative products referenced in background art section of the present disclosure. In various examples, an aerosol delivery device can comprise a reservoir configured to retain the aerosol precursor composition. In some embodiments, the reservoir may comprise a tank or container, which may, for example, be formed in part of a plastic, such as polypropylene, configured to contain the aerosol precursor composition. Container walls can be flexible and can be collapsible. Container walls alternatively can be substantially rigid.

The reservoir of some embodiments can be formed at least in part of a porous material (e.g., a fibrous material) and thus may be referred to as a porous substrate (e.g., a fibrous substrate). The reservoir may also be contained within or otherwise surrounded by a ferrite material to facilitate induction heating. In some embodiments, an aerosol delivery device may use replaceable cartridges, which may include a reservoir containing aerosol precursor composition prepared in accordance with various example embodiments disclosed herein. A fibrous substrate useful as a reservoir in some aerosol delivery devices can be a woven or nonwoven material formed of a plurality of fibers or filaments and can be formed of one or both of natural fibers and synthetic fibers. For example, a fibrous substrate may comprise a fiberglass material. In particular examples, a cellulose acetate material can be used. In other example implementations, a carbon material can be used. A reservoir may be substantially in the form of a container and may include a fibrous material included therein.

Figure 3:
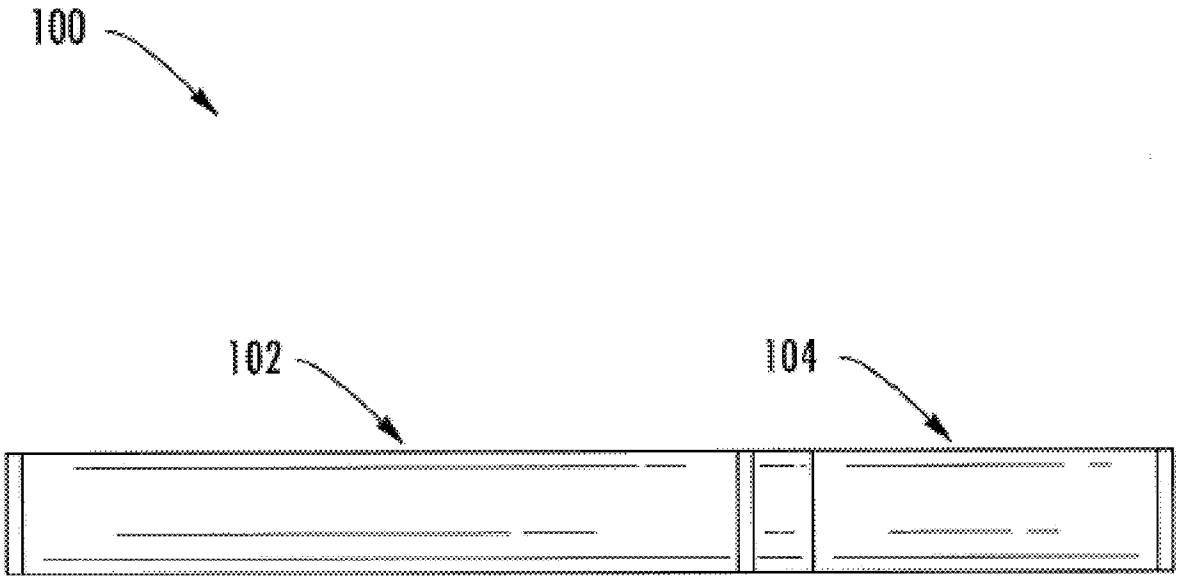
FIG. 3 illustrates a side view of an aerosol delivery device including a cartridge coupled to a control body, according to an example implementation of the present disclosure.

FIG. 3 illustrates a side view of an aerosol delivery device 100 including a control body 102 and a cartridge 104, according to various example implementations of the present disclosure. In particular, FIG. 3 illustrates the control body and the cartridge coupled to one another. The control body and the cartridge may be detachably aligned in a functioning relationship. Various mechanisms may connect the cartridge to the control body to result in a threaded engagement, a press-fit engagement, an interference fit, a magnetic engagement or the like. The aerosol delivery device may be substantially rod-like, substantially tubular shaped, or substantially cylindrically shaped in some example implementations when the cartridge and the control body are in an assembled configuration. The aerosol delivery device may also be substantially rectangular or rhomboidal in cross-section, which may lend itself to greater compatibility with a substantially flat or thin-film power source, such as a power source including a flat battery. The cartridge and control body may include separate, respective housings or outer bodies, which may be formed of any of a number of different materials. The housing may be formed of any suitable, structurally-sound material. In some examples, the housing may be formed of a metal or alloy, such as stainless steel, aluminum or the like. Other suitable materials include various plastics (e.g., polycarbonate), metal-plating over plastic, ceramics and the like.

In some example implementations, one or both of the control body 102 or the cartridge 104 of the aerosol delivery device 100 may be referred to as being disposable or as being reusable. For example, the control body may have a replaceable battery or a rechargeable supercapacitor, and thus may be combined with any type of recharging technology, including connection to a typical wall outlet, connection to a car charger (i.e., a cigarette lighter receptacle), connection to a computer, such as through a universal serial bus (USB) cable or connector, connection to a wireless radio-frequency (RF) charger, or connection to a photovoltaic cell (sometimes referred to as a solar cell) or solar panel of solar cells. Some examples of suitable recharging technology are described below. Further, in some example implementations, the cartridge may comprise a single-use cartridge, as disclosed in U.S. Pat. No. 8,910,639 to Chang et al., which is incorporated herein by reference in its entirety.

Figure 4:
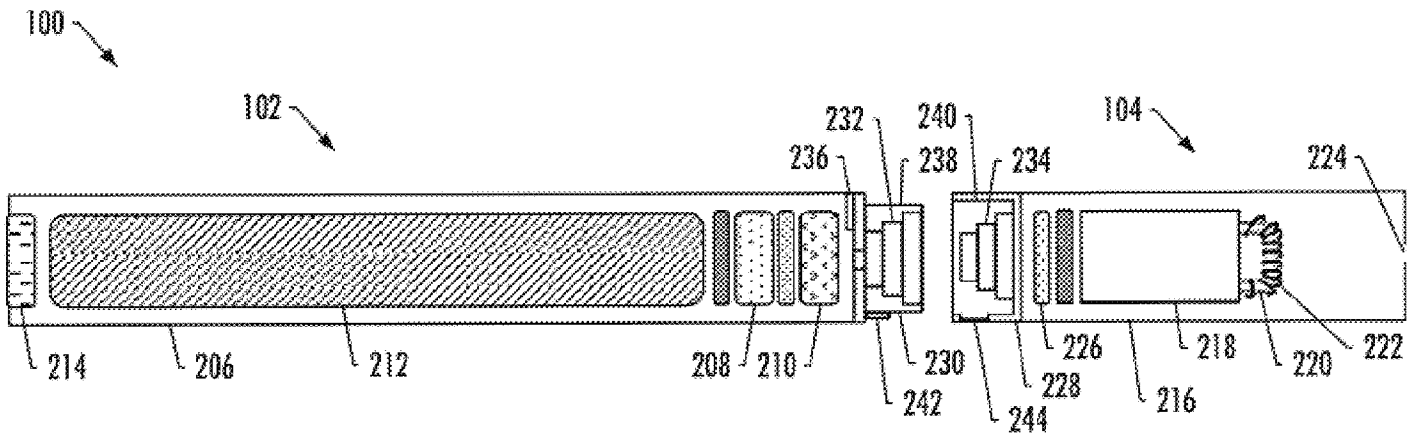
FIG. 4 is a partially cut-away view of the aerosol delivery device according to various example implementations.

FIG. 4 more particularly illustrates the aerosol delivery device 100, in accordance with some example implementations. As seen in the cut-away view illustrated therein, again, the aerosol delivery device can comprise a control body 102 and a cartridge 104 each of which include a number of respective components. The components illustrated in FIG. 4 are representative of the components that may be present in a control body and cartridge and are not intended to limit the scope of components that are encompassed by the present disclosure. As shown, for example, the control body can be formed of a control body shell 206 that can include various electronic components such as a control component 208 (e.g., an electronic analog component), a sensor 210, a power source 212 and one or more light-emitting diodes (LEDs) 214 (e.g., organic light emitting diodes (OLEDs)) and such components can be variably aligned. The flow sensor may include a number of suitable sensors such as an accelerometer, gyroscope, optical sensor, proximity sensor, or the like.

The power source 212 may be or include a suitable power supply such as a lithium-ion battery, solid-state battery or supercapacitor as disclosed in U.S. Patent Application Pub. No. 2017/0112191 to Sur et al., which is incorporated herein by reference. Examples of suitable solid-state batteries include STMicroelectronics' EnFilm™ rechargeable solid-state lithium thin-film batteries. Examples of suitable supercapacitors include electric double-layer capacitor (EDLC), a hybrid capacitor such as a lithium-ion capacitor (LIC), or the like.

In some example implementations, the power source 212 may be a rechargeable power source configured to deliver current to the control component 208 (e.g., an analog electronic component). In these examples, the power source may be connected to a charging circuit via a resistance temperature detector (RTD). The RTD may be configured to signal the charging circuit when the temperature of the power source exceeds a threshold amount, and the charging circuit may disable charging of the power source in response thereto. In these examples, safe charging of the power source may be ensured independent of a digital processor (e.g., a microprocessor) and/or digital processing logic.

The LEDs 214 may be one example of a suitable visual indicator with which the aerosol delivery device 100 may be equipped. In some examples, the LEDs may include organic LEDs or quantum dot-enabled LEDs. Other indicators such as audio indicators (e.g., speakers), haptic indicators (e.g., vibration motors) or the like can be included in addition to or as an alternative to visual indicators such as the LEDs including the organic LEDs or quantum dot-enabled LEDs.

The cartridge 104 can be formed of a cartridge shell 216 enclosing a reservoir 218 that is in fluid communication with a liquid transport element 220 adapted to wick or otherwise transport an aerosol precursor composition stored in the reservoir housing to a heater 222 (sometimes referred to as a heating element). In various configurations, this structure may be referred to as a tank; and accordingly, the terms "tank," "cartridge" and the like may be used interchangeably to refer to a shell or other housing enclosing a reservoir for aerosol precursor composition, and including a heater. In some example, a valve may be positioned between the reservoir and heater, and configured to control an amount of aerosol precursor composition passed or delivered from the reservoir to the heater. In various embodiments, the disclosed aerosol precursor is contained within a cartridge. Such an aerosol precursor can comprise the components described generally herein and may be prepared according to the methods outlined in the present disclosure.

Various examples of materials configured to produce heat when electrical current is applied therethrough may be employed to form the heater 222. The heater in these examples may be a resistive heating element such as a wire coil, microheater or the like. Example materials from which the wire coil may be formed include Kanthal (FeCrAl), Nichrome, Molybdenum disilicide ($MoSi_2$), molybdenum silicide (MoSi), Molybdenum disilicide doped with Aluminum ($Mo(Si,Al)_2$), Titanium (Ti), graphite and graphite-based materials (e.g., carbon-based foams and yarns) and ceramics (e.g., positive or negative temperature coefficient ceramics). Example implementations of heaters or heating members useful in aerosol delivery devices according to the present disclosure are further described below, and can be incorporated into devices such as illustrated in FIG. 4 as described herein.

An opening 224 may be present in the cartridge shell 216 (e.g., at the mouthend) to allow for egress of formed aerosol from the cartridge 104. In addition to the heater 222, the cartridge 104 also may include one or more other electronic components 226. These electronic components may include an integrated circuit, a memory component, a sensor, or the like. The electronic components may be adapted to communicate with the control component 208 and/or with an external device by wired or wireless means. The electronic components may be positioned anywhere within the cartridge or a base 228 thereof.

Although the control component 208 and the sensor 210 are illustrated separately, it is understood that the control component and the sensor may be combined as an electronic circuit board. Further, the electronic circuit board may be positioned horizontally relative the illustration of FIG. 4 in that the electronic circuit board can be lengthwise parallel to the central axis of the control body. In some examples, the sensor may comprise its own circuit board or other base element to which it can be attached. In some examples, a flexible circuit board may be utilized. A flexible circuit board may be configured into a variety of shapes, include substantially tubular shapes. In some examples, a flexible circuit board may be combined with, layered onto, or form part or all of a heater substrate as further described below.

The control body 102 and the cartridge 104 may include components adapted to facilitate a fluid engagement therebetween. As illustrated in FIG. 4, the control body can include a coupler 230 having a cavity 232 therein. The base 228 of the cartridge can be adapted to engage the coupler and can include a projection 234 adapted to fit within the cavity. Such engagement can facilitate a stable connection between the control body and the cartridge as well as establish an electrical connection between the power source 212 and control component 208 in the control body and the heater 222 in the cartridge. Further, the control body shell 206 can include an air intake 236, which may be a notch in the shell where it connects to the coupler that allows for passage of ambient air around the coupler and into the shell where it then passes through the cavity 232 of the coupler and into the cartridge through the projection 234.

In use, the heater 222 is activated to vaporize components of the aerosol precursor composition. Drawing upon the mouthend of the aerosol delivery device causes ambient air to enter the air intake 236 and pass through the cavity 232 in the coupler 230 and the central opening in the projection 234 of the base 228. In the cartridge 104, the drawn air combines with the formed vapor to form an aerosol. The aerosol is whisked, aspirated or otherwise drawn away from the heater and out the opening 224 in the mouthend of the aerosol delivery device.

A coupler and a base useful according to the present disclosure are described in U.S. Pat. App. Pub. No. 2014/0261495 to Novak et al., which is incorporated herein by reference in its entirety. For example, the coupler 230 as seen in FIG. 4 may define an outer periphery 238 configured to mate with an inner periphery 240 of the base 228. In one example the inner periphery of the base may define a radius that is substantially equal to, or slightly greater than, a radius of the outer periphery of the coupler. Further, the coupler may define one or more protrusions 242 at the outer periphery configured to engage one or more recesses 244 defined at the inner periphery of the base. However, various other examples of structures, shapes and components may be employed to couple the base to the coupler. In some examples the connection between the base of the cartridge 104 and the coupler of the control body 102 may be substantially permanent, whereas in other examples the connection therebetween may be releasable such that, for example, the control body may be reused with one or more additional cartridges that may be disposable and/or refillable.

The aerosol delivery device 100 may be substantially rod-like or substantially tubular shaped or substantially cylindrically shaped in some examples. In other examples, further shapes and dimensions are encompassed—e.g., a rectangular or triangular cross-section, multifaceted shapes, or the like.

The reservoir 218 illustrated in FIG. 4 can be a container or can be a fibrous reservoir, as presently described. For example, the reservoir can comprise one or more layers of nonwoven fibers substantially formed into the shape of a tube encircling the interior of the cartridge shell 216, in this example. An aerosol precursor composition (as described herein) can be retained in the reservoir. Liquid components, for example, can be sorptively retained by the reservoir. The reservoir can be in fluid connection with the liquid transport element 220. The liquid transport element can transport the aerosol precursor composition stored in the reservoir via capillary action to the heater 222 that is in the form of a metal wire coil in this example. As such, the heater is in a heating arrangement with the liquid transport element. Example implementations of reservoirs and transport elements useful in aerosol delivery devices according to the present disclosure are further described below, and such reservoirs and/or transport elements can be incorporated into devices such as illustrated in FIG. 4 as described herein. In particular, specific combinations of heating members and transport elements as further described below may be incorporated into devices such as illustrated in FIG. 4 as described herein.

The various components of an aerosol delivery device can be chosen from components described in the art and commercially available. Examples of batteries that can be used according to the disclosure are described in U.S. Pat. App. Pub. No. 2010/0028766 to Peckerar et al., which is incorporated herein by reference in its entirety.

The aerosol delivery device 100 can incorporate the sensor 210 or another sensor or detector for control of supply of electric power to the heater 222 when aerosol generation is desired. As such, for example, there is provided a manner or method of turning off power to the heater when the aerosol delivery device, and for turning on power to actuate or trigger the generation of heat by the heater during draw. Additional representative types of sensing or detection mechanisms, structure and configuration thereof, components thereof, and general methods of operation thereof, are described in U.S. Pat. No. 5,261,424 to Sprinkel, Jr., U.S. Pat. No. 5,372,148 to McCafferty et al., and PCT Pat. App. Pub. No. WO 2010/003480 to Flick, all of which are incorporated herein by reference in their entireties.

The aerosol delivery device 100 most preferably incorporates the control component 208 or another control mechanism for controlling the amount of electric power to the heater 222. Representative types of electronic components, structure and configuration thereof, features thereof, and general methods of operation thereof, are described in U.S. Pat. No. 4,735,217 to Gerth et al., U.S. Pat. No. 4,947,874 to Brooks et al., U.S. Pat. No. 5,372,148 to McCafferty et al., U.S. Pat. No. 6,040,560 to Fleischhauer et al., U.S. Pat. No. 7,040,314 to Nguyen et al., U.S. Pat. No. 8,205,622 to Pan, U.S. Pat. App. Pub. No. 2009/0230117 to Fernando et al., U.S. Pat. App. Pub. No. 2014/0060554 to Collet et al., U.S. Pat. App. Pub. No. 2014/0270727 to Ampolini et al., and U.S. Pat. App. Pub. No. 2015/0257445 to Henry et al., all of which are incorporated herein by reference in their entireties.

Representative types of substrates, reservoirs or other components for supporting the aerosol precursor are described in U.S. Pat. No. 8,528,569 to Newton and U.S. Pat. App. Pub. Nos. 2014/0261487 to Chapman et al., 2015/0059780 to Davis et al., and 2015/0216232 to Bless et al., all of which are incorporated herein by reference in their entireties. Additionally, various wicking materials, and the configuration and operation of those wicking materials within certain types of electronic cigarettes, are set forth in U.S. Pat. App. Pub. No. 2014/0209105 to Sears et al., which is incorporated herein by reference in its entirety.

Additional representative types of components that yield visual cues or indicators may be employed in the aerosol delivery device 100, such as visual indicators and related components, audio indicators, haptic indicators and the like. Examples of suitable LED components, and the configurations and uses thereof, are described in U.S. Pat. No. 5,154,192 to Sprinkel et al., U.S. Pat. No. 8,499,766 to Newton, U.S. Pat. No. 8,539,959 to Scatterday, and U.S. Pat. No. 9,451,791 to Sears et al., all of which are incorporated herein by reference in their entireties.

Yet other features, controls or components that can be incorporated into aerosol delivery devices of the present disclosure are described in U.S. Pat. No. 5,967,148 to Harris et al., U.S. Pat. No. 5,934,289 to Watkins et al., U.S. Pat. No. 5,954,979 to Counts et al., U.S. Pat. No. 6,040,560 to Fleischhauer et al., U.S. Pat. No. 8,365,742 to Hon, U.S. Pat. No. 8,402,976 to Fernando et al., U.S. Pat. App. Pub. No. 2005/0016550 to Katase, U.S. Pat. App. Pub. No. 2010/0163063 to Fernando et al., U.S. Pat. App. Pub. No. 2013/0192623 to Tucker et al., U.S. Pat. App. Pub. No. 2013/0298905 to Leven et al., U.S. Pat. App. Pub. No. 2013/0180553 to Kim et al., U.S. Pat. App. Pub. No. 2014/0000638 to Sebastian et al., U.S. Pat. App. Pub. No. 2014/0261495 to Novak et al., and U.S. Pat. App. Pub. No. 2014/0261408 to DePiano et al., all of which are incorporated herein by reference in their entireties.

The control component 208 includes a number of electronic components, and in some examples may be formed of a printed circuit board (PCB) that supports and electrically connects the electronic components. The electronic components may include an analog electronic component configured to operate independent of a digital processor (e.g., a microprocessor) and/or digital processing logic. In some examples, the control component may be coupled to a communication interface to enable wireless communication with one or more networks, computing devices or other appropriately-enabled devices. Examples of suitable communication interfaces are disclosed in U.S. Pat. App. Pub. No. 2016/0261020 to Marion et al., the contents of which is incorporated by reference in its entirety. And examples of suitable manners according to which the aerosol delivery device may be configured to wirelessly communicate are disclosed in U.S. Pat. App. Pub. No. 2016/0007651 to Ampolini et al. and U.S. Pat. App. Pub. No. 2016/0219933 to Henry, Jr. et al., each of which is incorporated herein by reference in its entirety.

Although the disclosure encompasses aerosol precursors as described herein which are contained within cartridges or reservoirs, as provided above, the containment of such precursors is not limited thereto. In some embodiments, the aerosol precursor is provided within a container (e.g., bottle) designed to store the aerosol precursor for some period of time before use. For example, a container (e.g., bottle) of aerosol precursor for use in aerosol delivery devices can be provided from which a user may refill a cartridge or container. Such containers can, in some embodiments, be prepared in accordance with the method of various embodiments as outlined herein.

EXAMPLE 1

A sample of lactic acid (listed as 85% purity) was evaluated and determined to comprise mostly L-lactic acid. The sample was roughly analyzed for lactic acid content directly out of the container by LC-MS (referred to in Table 1, below, as "Start"). As shown, this sample was found to have 70.99% lactic acid monomer, based on the area under the peak curve. The sample was diluted to a 50% aqueous solution by weight and the resulting diluted sample was placed in a HDPE bottle in a sealed environment chamber at 40° C., 75% relative humidity. The diluted sample within the chamber was sampled at week 0 (immediately after dilution and before placing the bottle in the chamber, at week 1 (1 week after placing the diluted sample in the chamber), and at week 2 (2 weeks after placing the diluted sample in the chamber); the results are presented below in Table 1.

TABLE 1

Lactic Acid Content over Time (50% dilution, 40° C., 75% RH)

| Time | Percent monomer |
|---|---|
| Start | 70.99 |
| Week 1 | 73.53 |
| Week 2 | 83.81 |
| Week 3 | 87.39 |

EXAMPLE 2

Samples of D,L-lactic acid (listed as 90% purity) and L-lactic acid (listed as 98% purity) were obtained from a commercial source. Water (18.2 m'Ω/cm) was obtained from a Barnsted Nanopure Unit (Thermo Scientific, Rockford, Ill.). Samples were analyzed by liquid chromatography/mass spectroscopy (LC-MS) on a Waters UPLC Acquity I with a Synergy Hydro-RP 250×3.0 mm column with 4 μm particles from Phenomenex (Torrance, Calif.), equipped with a QDa single quadruple MS detector (Waters Corp., Milford, Mass.). Detection at an ion m/z of 161.100 was determined to represent lactic acid dimer and detection at an ion m/z of 89 was determined to represent lactic acid.

It is noted that, due to the equilibrium of the species to be analyzed, it was not feasible to use pure standards of lactic acid, lactic acid dimer, lactic acid trimer, etc. for comparison (to use for quantifying the amount of each species in tested samples and determining the total acidity). As a rough estimate, the mass spectrum ratio of lactic acid to lactic acid dimer is used to estimate the extent of hydrolysis. It is understood that this method is somewhat limited by the different ionization yield of the different species. It appears that lactic acid ionizes about ⅓ as well as lactic acid dimer; therefore, as a correction factor, the area of lactic acid dimer is multiplied by ⅓, allowing for a more accurate estimation of the relative concentrations. Using the relative ratios, it is possible to track the extent of hydrolysis and determine how long to heat lactic acid solutions to reach equilibrium, as outlined below.

A sample of commercially available D,L-lactic acid is diluted with water on a weight-by-weight basis to obtain diluted samples ranging from 15% to 65% lactic acid. The weights of water and the lactic acid are measured on an analytical balance, with weights shown in Table 2, below. The solutions are thoroughly mixed and analyzed by LC-MS to determine the initial lactic acid: lactic acid dimer ratio. Each sample is split roughly in half, and sealed in 2 mL GC-MS vials for thermal hydrolysis (giving 14 samples, 2 of each concentration).

TABLE 2

Analysis of Lactic Acid Content in Commercial Samples (various dilutions)

| Target % Lactic Acid | Amount Commercial Lactic Acid Used (mg) | Amount Water Used (mg) | Actual % Lactic Acid determined (accounting for water)* |
|---|---|---|---|
| 65 | 974.5 | 526.8 | 56.6 |
| 55 | 826.3 | 679.3 | 47.9 |
| 45 | 674.5 | 826.5 | 39.2 |
| 35 | 524.5 | 971.5 | 30.6 |

TABLE 2-continued

Analysis of Lactic Acid Content in Commercial Samples (various dilutions)

| Target % Lactic Acid | Amount Commercial Lactic Acid Used (mg) | Amount Water Used (mg) | Actual % Lactic Acid determined (accounting for water)* |
|---|---|---|---|
| 25 | 374.7 | 1129.3 | 21.7 |
| 20 | 300.1 | 1198 | 17.5 |
| 15 | 224.6 | 1275.7 | 13.1 |

*The Certificate of Analysis for the lactic acid indicates 12.8% water. The Actual % Lactic Acid was determined by correcting for the 12.8% water.

Figure 5A:
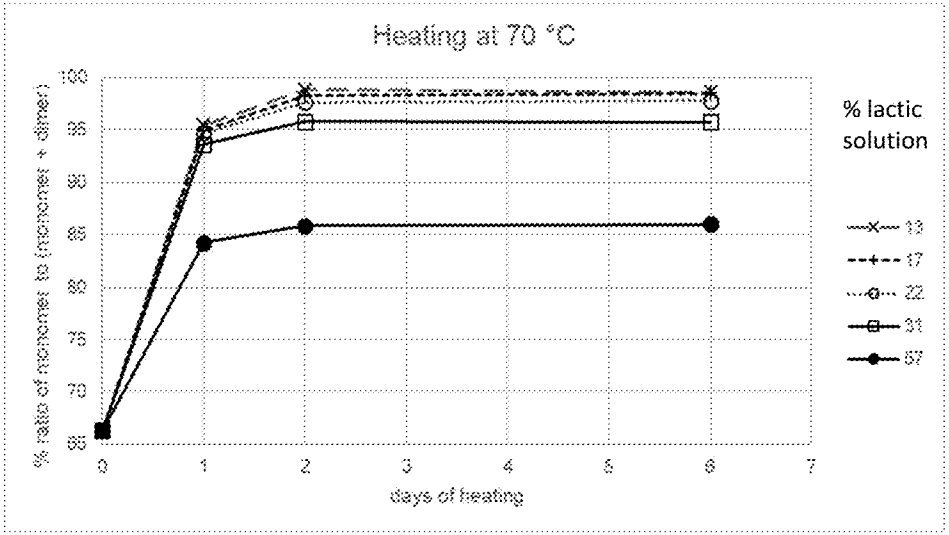
FIGS. 5A and 5B are plots of LC-MS ratios of lactic acid monomer to lactic acid (monomer+dimer) at two different temperatures.
Figure 5B:
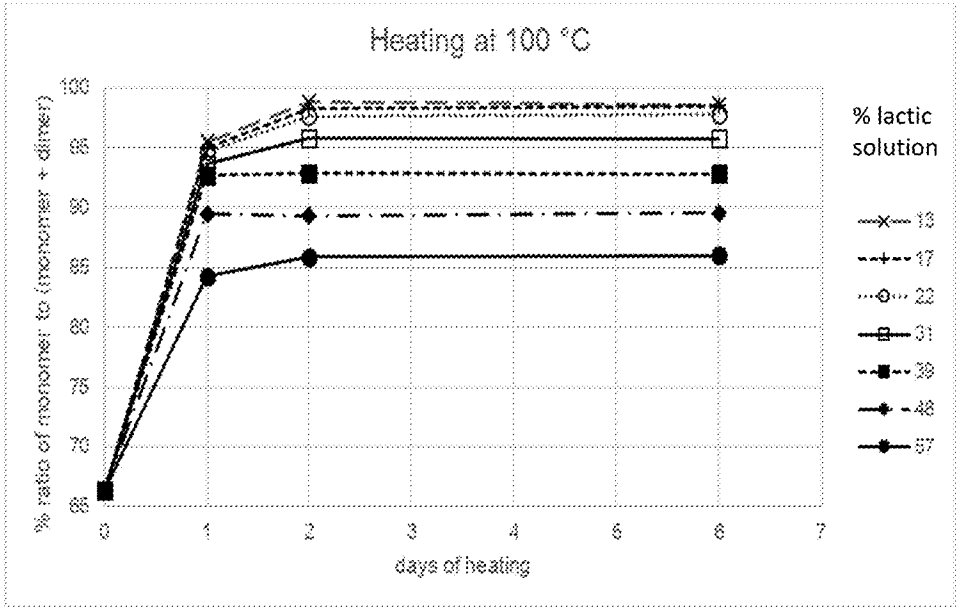

Each vial is tightly sealed and placed on a 70° C. heating block or 100° C. heating block (Temp-Block module heaters from American Scientific Products) and allowed to heat for 6 days. An aliquot of ~2 μL is removed from each vial at 24, 48, and 144 hour time points. Each collected aliquot is cooled to room temperature for 30 minutes, diluted with 1.9 mL water, and analyzed by LC-MS to determine the increase in ratio of lactic acid: lactic acid dimer as compared with the initial sample. The results are shown in FIGS. 5A and 5B. The y-axis for these plots was calculated using the following formula:

$$\%\ \text{Ratio} = \frac{\text{area (lactic acid)}}{\text{area}\left(\text{lactic acid} + \frac{1}{3}\ \text{area (lactic acid dimer)}\right)} \times 100$$

As shown in FIGS. 5A and 5B, it is determined that lactic acid hydrolysis in this study is complete at 70° C. after 48 hours. If the samples are heated at higher temperature (100° C.), lactic acid hydrolysis is complete after only 24 hours.

Figure 6:
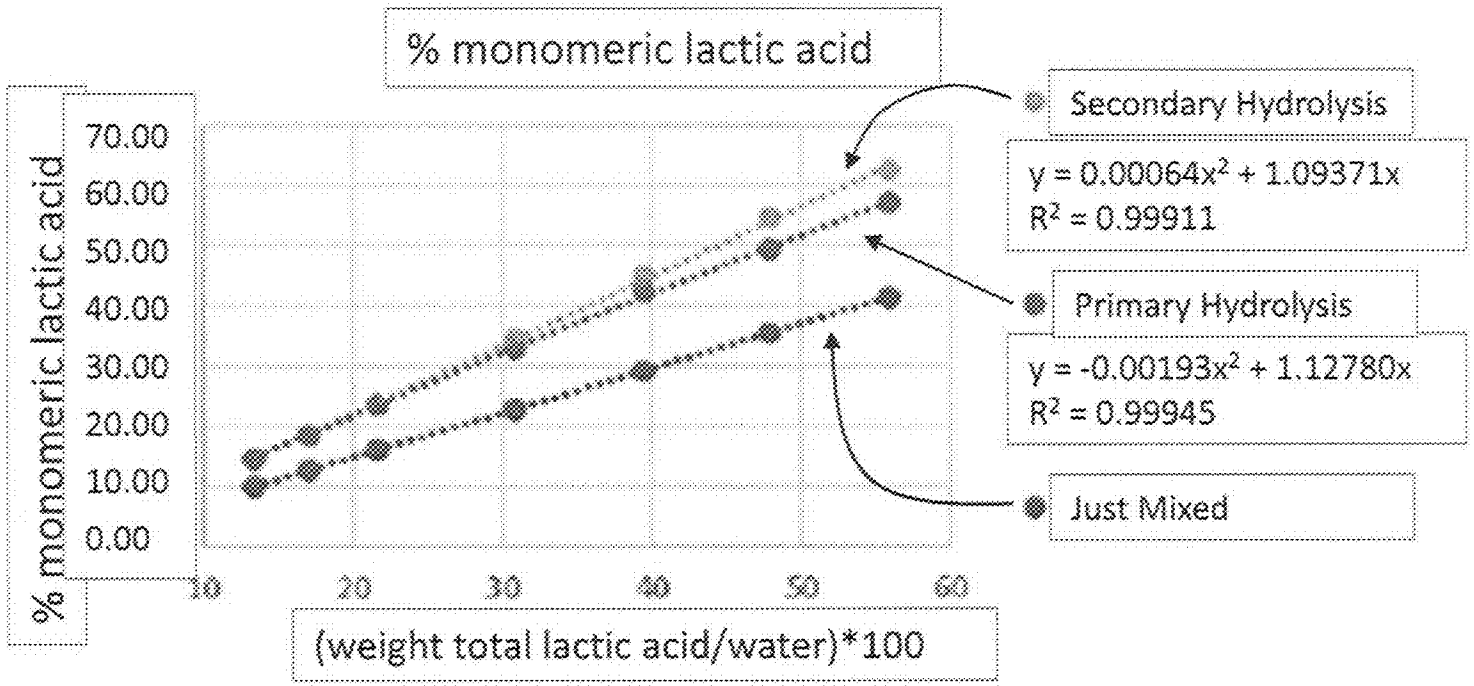
FIG. 6 is a plot of percent monomeric lactic acid of samples at various times, including "just mixed," primary hydrolysis, and secondary hydrolysis results.

In an effort to determine the amount of lactic acid dimers, trimers, and polymeric lactic acid compounds present after initial hydrolysis, approximately 15 mg of each hydrolyzed sample above (7 samples of varying initial lactic acid concentrations) is further diluted into 100 mL of water. From each of these solutions, a 40 μL aliquot is obtained and further diluted with 960 μL water in a 2 mL vial. Each such diluted solution is subjected to "secondary" hydrolysis at 100° C. for 24 hours and allowed to cool. A 20 μL aliquot of internal standard (a sodium salt of d3-lactic acid) is added to each cooled solution. These samples are subjected to LC-MS quantification as described above. This process was employed to determine the amount of lactic acid existing in polymeric form (as reliable standards are not available as referenced herein). By combining these results with those obtained from the percent lactic acid at mixing and the results after primary hydrolysis, the benefits of hydrolysis are clearly demonstrated, as depicted in FIG. 6. The difference between the composition upon mixing and the composition after primary hydrolysis highlights how much the lactic acid can increase over time at various dilutions.

Prior to hydrolysis, the total lactic acid in the 90% sample was found to be ~66% lactic acid (34% dimeric/oligomeric/polymeric lactic acid). Dilution with water gives the "Just Mixed" curve shown in FIG. 6 (this curve is dependent on the % lactic acid in the obtained sample and can vary from batch to batch and vendor to vendor). Primary hydrolysis is demonstrated to hydrolyze a large portion of the non-monomeric forms (e.g., dimer, oligomer, polymer forms) to monomeric lactic acid (shown as the "Primary Hydrolysis" curve in FIG. 6). The change from the "Just Mixed" curve to the "Primary Hydrolysis" curve demonstrates why e-liquids undergo pH decrease over time. The "Secondary Hydrolysis" curve is the result when all compounds of the lactic acid sample are converted to the monomer and the difference between the "Primary Hydrolysis" curve and the "Secondary Hydrolysis" curve indicates how much lactic acid oligomer is present.

Based on FIG. 6, equations are developed that can roughly determine the amount of monomer and the amount of dimer a sample will have after equilibration (between the starting ranges of 15-55% total lactic acid). Coefficients for calculating acidity at dilution ratios between 15-55% lactic acid are also provided in Table 3, below.

TABLE 3

Coefficients for Calculating Acidity

| | a | b |
|---|---|---|
| Primary | −0.00193 | 1.1278 |
| Secondary | 0.00064 | 1.09371 |
| Difference (calculated) | 0.00257 | −0.03409 |

As an example calculation based on the information determined via FIG. 6/Table 3, if lactic acid is mixed with water to a concentration of 50% and heated to 100° C. for 24 hours, the amount of free lactic acid can be determined by multiplying "x" (concentration)=50 by the primary coefficients in Table 3 (Equation 2). The lactic acid dimer (as lactic acid) can be determined using the difference coefficients (Equation 3). The addition of 51.57 and 4.72×0.5 (lactic acid dimer is a dimer with ½ the available acidity) yields an available acidity of 53.93 (as lactic acid). Further example calculations are shown below in Table 4. These can be used to quickly estimate how much lactic acid could be available at a particular dilution.

$$\text{Primary}=50^2\times(-0.00193)\times1.1278=51.57\%\text{ lactic acid} \quad \text{Equation 2}$$

$$\text{Difference}=50^2\times0.0257+50\times-0.03409=4.72\text{ dimer (lactic acid dimer)} \quad \text{Equation 3}$$

TABLE 4

Example results for calculating concentrations from weight % lactic acid

| Weight % Lactic Acid | Primary Hydrolysis (% Lactic Acid) | Difference (Lactic Acid dimer) | Secondary Hydrolysis (Total as Lactic Acid) | % as Monomer |
|---|---|---|---|---|
| 15 | 16.48 | 0.07 | 16.55 | 99.60 |
| 25 | 26.99 | 0.75 | 27.74 | 97.28 |
| 35 | 37.11 | 1.96 | 39.06 | 95.00 |
| 45 | 46.84 | 3.67 | 50.51 | 92.73 |
| 55 | 56.19 | 5.90 | 62.09 | 90.50 |

EXAMPLE 3

Figure 7:
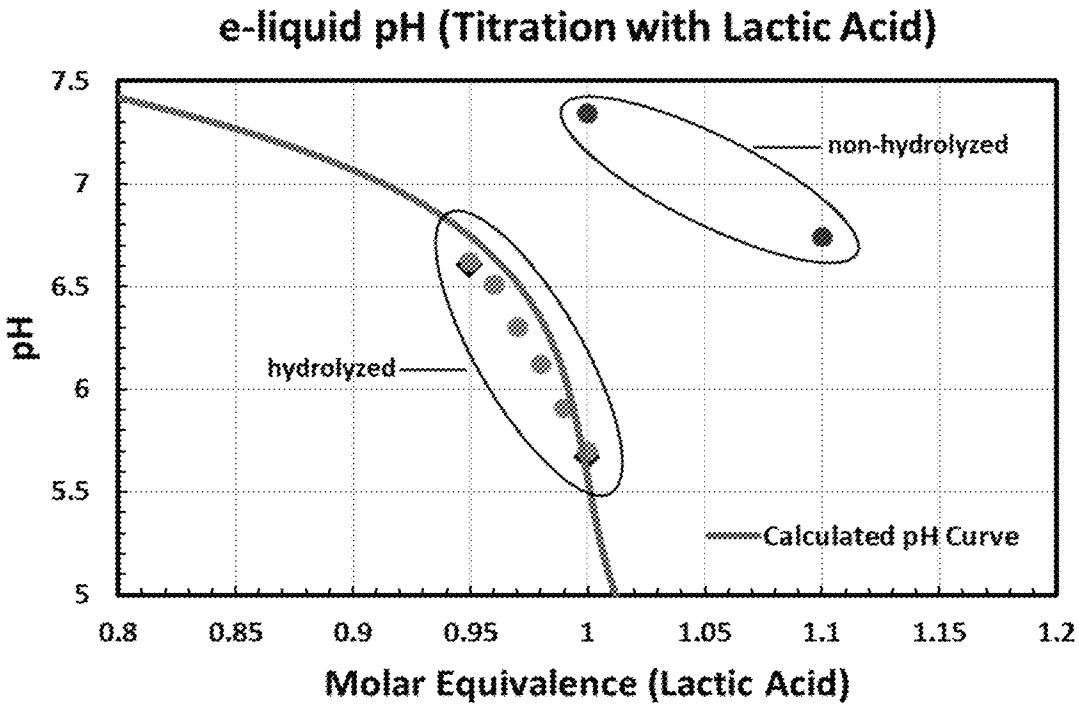
FIG. 7 is a plot of the pH of 5% nicotine-containing e-liquids containing hydrolyzed and non-hydrolyzed lactic acid.

To understand the formulary control that upfront hydrolysis affords, the effect of hydrolyzed and non-hydrolyzed lactic acid on the pH of a model 5% nicotine-containing solution was studied. In FIG. 7, the calculated (or predicted) pH titration curve for nicotine is shown. For the experiment, two different hydrolysis methods were compared against non-hydrolyzed lactic acid. The two hydrolysis methods consisted of incubating of an ~51/49 (% w/w) lactic acid water solution for: 1) 4 weeks at 40° C. and 2) 48 hrs at 70° C. Hydrolyzed lactic acid from the 4 week method was stoichiometrically added from 0.95 to 1.0 molar equivalence to nicotine (represented by the circles along the curve). Hydrolyzed lactic acid from the 48 hr method was stoichiometrically added at only 0.95 to 1.0 molar equivalence (represented by the black diamonds). The two methods resulted in solutions that differ by less than 0.03 pH units at the ends of the titration range, thereby demonstrating parity between the methods. In addition, the resulting pH for both methods closely align with the predicted pH curve for titration of nicotine with a weak acid. In stark contrast, addition of non-hydrolyzed lactic acid at both 1.0 and 1.1 molar equivalence (upper two circles within oval labeled as "non-hydrolyzed") dramatically differs from the predicted pH curve. Together these data indicate that non-hydrolyzed lactic acid is poor choice for formulary control if the pH of the resulting solution is of any concern and that multiple hydrolysis approaches can be employed with similar results.

EXAMPLE 4

Figure 8A:
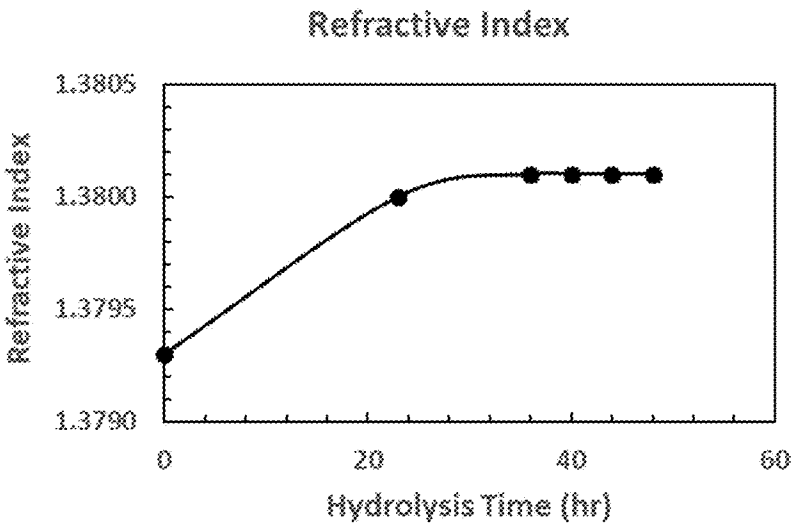
FIGS. 8A and 8B are plots of refractive index and specific gravity of lactic acid samples as a function of hydrolysis time.
Figure 8B:
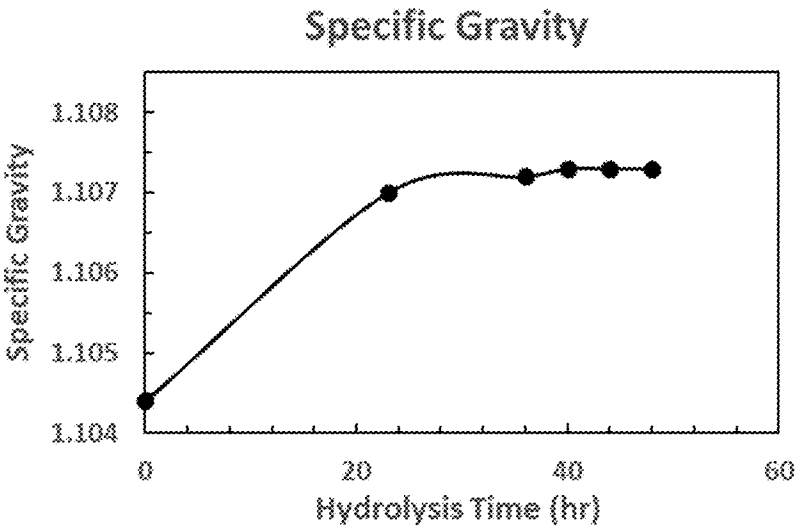

Analytical methods for verifying hydrolysis ("pre-treatment") reaction completeness were evaluated. Two metrics, namely, specific gravity and refractive index, were evaluated during a 48 hr hydrolysis at 70° C. for a 50/50 (% w/w) lactic acid (88%)/water solution. As shown in FIGS. 8A and 8B and Table 5 below, both of these metrics demonstrated an initial increase before leveling off after 24 hrs. Both specific gravity and refractive index curves mirror LC-MS curves of lactic acid: lactic acid dimer ratios during the course of hydrolysis. In other words, both specific gravity and refractive index level off at precisely the same time that monomeric lactic acid reaches its maximum during hydrolysis. In addition, specific gravity is also appropriate for ensuring that excess water is not being driven off during the hydrolysis. This helps ensure that excess water is not being evaporated off and that the acid is not being subsequently concentrated.

TABLE 5

Example results of RI and specific gravity of a 50/50 (88%) lactic acid/water mixture over the course of a 48 hour/70° C. hydrolysis
Refractive Index and Specific Gravity (50/50, % w/w)

| Hydrolysis time | Refractive Index | Specific Gravity |
|---|---|---|
| 0 | 1.3793 | 1.1044 |
| 23 | 1.3800 | 1.1070 |
| 36 | 1.3801 | 1.1072 |
| 40 | 1.3801 | 1.1073 |
| 44 | 1.3801 | 1.1073 |
| 48 | 1.3801 | 1.1073 |

EXAMPLE 5

Figure 9:
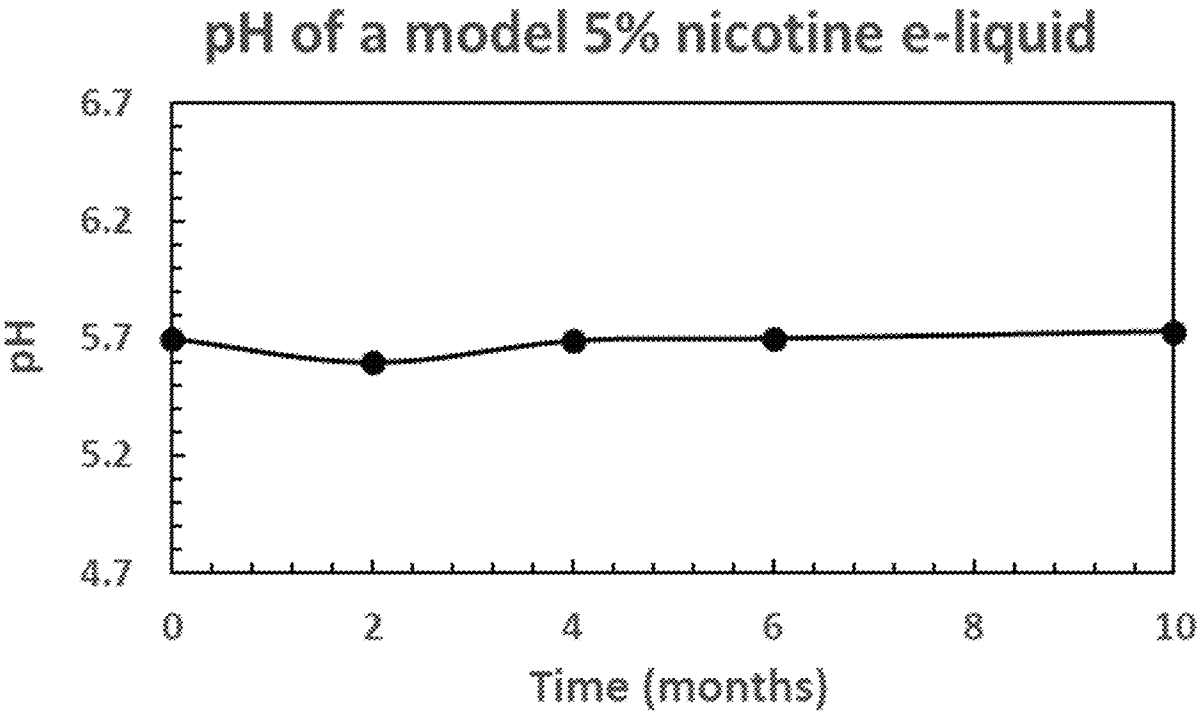
FIG. 9 is a plot of pH over time for an e-liquid comprising lactic acid hydrolyzed according to the present disclosure.

In addition to providing a known acid concentration, hydrolysis also imparts stability in regards to solution pH. In e-liquid formulas that contain water, any degree of lactic acid dimer or higher order oligomer would be subject to in situ hydrolysis on the shelf. This would cause the pH of the e-liquid to decrease over time. However, if hydrolysis is performed prior to acid inclusion, the shelf stability of the subsequent formula will be afforded significant pH stability. To experimentally demonstrate this, a hydrolyzed lactic acid was used in the formulation of a 5% nicotine-containing solution at 1 molar equivalence to nicotine (the solution further comprising glycerol, water, propylene glycol and flavor compounds). The solution was stored at 20° C. in a closed bottle with no inert gas headspace. The pH of this solution was monitored over time and is shown in FIG. 9 and Table 6, below. The pH of this model e-liquid differed by 0.03 pH units from t=0 to t=10 months, indicating the marked pH control that hydrolyzed lactic acid imparts.

TABLE 6

Example results of pH as a function of time for a model 5% nicotine-containing e-liquid formulation comprising hydrolyzed lactic acid. Model e-liquid pH over Time

| Time (months) | pH |
|---|---|
| 0 | 5.70 |
| 2 | 5.60 |
| 4 | 5.69 |
| 6 | 5.70 |
| 10 | 5.73 |

By contrast, it was found that an e-liquid prepared without subjecting the lactic acid component to pre-treatment/hydrolysis exhibited a decrease in pH over time. This trend was observed for such e-liquids stored in both bottles and in cartridges, with e.g., at least a 0.25 pH unit decrease (ranging from a 0.29 pH unit decrease to a 0.95 pH unit decrease) for various flavors tested after 9 months of storage.

Many modifications and other implementations of the disclosure set forth herein will come to mind to one skilled in the art to which this disclosure pertains having the benefit of the teachings presented in the foregoing descriptions and the associated drawings. Therefore, it is to be understood that the disclosure is not to be limited to the specific implementations disclosed, and that modifications and other implementations are intended to be included within the scope of the appended claims. Moreover, although the foregoing descriptions and the associated drawings describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A method for preparing an aerosol precursor composition, comprising:

providing a first aqueous solution comprising one or more organic acids in water;

subjecting the first aqueous solution to hydrolysis to give a hydrolyzed aqueous solution with a higher content of the one or more organic acids in monomer form on a dry weight basis than in the first aqueous solution; and combining the hydrolyzed aqueous solution with one or more aerosol formers to give an aerosol precursor composition.

2. The method of claim 1, further comprising adding nicotine to the hydrolyzed aqueous solution, the one or more aerosol formers, or a combination thereof to give the aerosol precursor composition.

3. The method of claim 2, wherein the nicotine is tobacco-derived.

4. The method of claim 2, wherein the nicotine is non-tobacco-derived.

5. The method of claim 1, wherein the aqueous solution comprises, in addition to the one or more organic acids, reaction products of the organic acids.

6. The method of claim 1, wherein the aqueous solution comprises, in addition to the one or more organic acids, one or more reaction products selected from the group consisting of acid dimers, acid trimers, acid oligomers, and acid polymers.

7. The method of claim 1, wherein the one or more organic acids are selected from the group consisting of levulinic acid, succinic acid, lactic acid, pyruvic acid, benzoic acid, fumaric acid, and combinations thereof.

8. The method of claim 1, wherein the one or more organic acids include lactic acid.

9. The method of claim 1, wherein the hydrolysis comprises heating the first aqueous solution.

10. The method of claim 1, wherein the first aqueous solution comprises at least about 10% by weight water.

11. The method of claim 1, wherein the hydrolyzed aqueous solution contains at least about 85% of the organic acid by dry weight.

12. The method of claim 1, wherein the hydrolyzed aqueous solution contains at least about 88% of the organic acid by dry weight.

13. The method of claim 1, wherein the hydrolyzed aqueous solution contains at least about 90% of the organic acid by dry weight.

14. The method of claim 1, wherein the hydrolyzed aqueous solution contains at least about 95% of the organic acid by dry weight.

15. The method of claim 1, wherein the one or more aerosol formers comprise polyols.

16. The method of claim 1, wherein the aerosol precursor composition has a pH less than about 8.

17. The method of claim 1, further comprising adding additional components before, after, or during the combining step.

18. The method of claim 17, wherein the additional components are flavorants.

19. The method of claim 1, further comprising incorporating the aerosol precursor composition within a cartridge for an aerosol delivery device.

* * * * *